US010788204B2

(12) United States Patent
Gu et al.

(10) Patent No.: US 10,788,204 B2
(45) Date of Patent: Sep. 29, 2020

(54) INJECTION FEEDWATER HEATER FOR STEAM POWER GENERATING SYSTEM

(71) Applicants: Xuedong Gu, Anaheim, CA (US); MingWei Tong, ChongQing (CN)

(72) Inventors: Xuedong Gu, Anaheim, CA (US); MingWei Tong, ChongQing (CN)

( * ) Notice: Subject to any disclaimer, the term of this patent is extended or adjusted under 35 U.S.C. 154(b) by 143 days.

(21) Appl. No.: 16/051,431

(22) Filed: Jul. 31, 2018

(65) Prior Publication Data

US 2020/0041120 A1 Feb. 6, 2020

(51) Int. Cl.
*F22D 1/32* (2006.01)
*F22D 1/00* (2006.01)

(52) U.S. Cl.
CPC ..... *F22D 1/325* (2013.01); *F22D 1/003* (2013.01)

(58) Field of Classification Search
CPC ... F22D 1/00; F22D 7/04; F22D 11/00; F22D 1/28; F22D 1/32; F22D 1/325; F22B 37/72
See application file for complete search history.

(56) References Cited

U.S. PATENT DOCUMENTS 4,656,335 A * 4/1987 Durrant ..... F01K 3/181 376/214
4,674,285 A * 6/1987 Durrant ..... F01K 3/181 376/214
6,109,037 A * 8/2000 Kumagai ..... F04F 5/26 60/677
7,174,715 B2 * 2/2007 Armitage ..... F01K 7/165 60/646
9,664,379 B2 * 5/2017 Hirata ..... F22D 11/06
2019/0056101 A1 * 2/2019 Weigold ..... F22B 1/1807

* cited by examiner

*Primary Examiner* — Gregory A Wilson
(74) *Attorney, Agent, or Firm* — Tsz Lung Yeung

(57) ABSTRACT

An injection feedwater heater for a steam power generating system includes at least one main heater body and at least one injection nozzle. The main heater body has at least one heat exchange compartment, at least one water inlet, at least one steam inlet, and at least one water outlet formed on the main heater body. The injection nozzle is provided in the main heater body at a position adjacent to the water inlet, wherein a predetermined amount of condensate water is arranged to be pumped into the main heater body through the water inlet. The condensate water passing through the water inlet is arranged to be injected into the heat exchange compartment through the injection nozzle for creating a negative pressure in the heat exchange compartment. The negative pressure drawing a predetermined amount of steam to enter the heat exchange compartment for mixing with the condensate water.

15 Claims, 22 Drawing Sheets

INJECTION FEEDWATER HEATER FOR STEAM POWER GENERATING SYSTEM

BACKGROUND OF THE PRESENT INVENTION

Field of Invention

The present invention relates to a power generating system, and more particularly to a steam power generating system for a steam power plant, wherein the steam power generating system comprises at least one injection feedwater heater which has enhanced heat exchange efficiency between steam and condensate water.

Description of Related Arts

A conventional power plant, such as a steam power plant, usually comprises a boiler, a turbine assembly including at least one turbine unit, a generator, a condenser and a feedwater heater. The boiler is arranged to generate steam which is then guided to produce work in the turbine assembly. The steam may spin or rotate the turbine unit which is connected to the generator. When the turbine unit is rotated, the generator is arranged to produce electricity. Heat energy is then converted into mechanical energy which is then further converted into electrical energy.

Conventionally, the steam used to turn the turbine unit is guided to enter into a condenser in which the steam is arranged to be cooled down and condensed into water. The condensate water may then be guided to enter a feedwater heater. The feedwater heater is arranged to raise the temperature of the water by utilizing extraction steam from various stages of the turbine assembly.

Two conventional types of feedwater heaters have been used. Feedwater heaters may be open heat exchangers in which extracted steam may be allowed to mix with condensate water. On the other hand, feedwater heaters may also be closed in which condensate water and steam perform heat exchange through a plurality of heat exchanging tubes. As a matter of conventional practices, most feedwater heaters employed in steam power plants are closed feedwater heaters.

A major disadvantage of closed feedwater heaters is that they have relatively low heat exchange efficiency and complicated installation and manufacturing procedures. Since heat exchange between condensate water and steam are through heat exchanging tubes, a typical closed feedwater heater may comprise many heat exchanges tubes which may be arranged in manifold for maximizing the surface area through which heat exchange process may take place. The manufacturing and installation of this type of feedwater heaters are very complicated and expensive in costs.

As a result, there is a need to develop a new type of feedwater heater which is suitable to be utilized in a steam power plant or other situations.

SUMMARY OF THE PRESENT INVENTION

Certain variations of the present invention provide a steam power generating system comprising an injection feedwater heater with enhanced heat exchange efficiency between steam and condensate water.

Certain variations of the present invention provide an injection feedwater heater for use in a steam power generating system, wherein steam and condensate water may be evenly and effectively mixed for preheating condensate water before it is circulated back to a steam generator.

In one aspect of the present invention, it provides a steam power generating system, comprising:

a plurality of connecting pipes;

a steam generator arranged to produce a predetermined amount of steam;

a turbine assembly comprising at least one turbine connected to the steam generator through at least one of the connecting pipes, the steam generated by the steam generator being arranged to produce work on the turbine assembly;

an electric generator connected to the turbine assembly, the work produced in the turbine assembly being converted to a predetermined amount of electricity;

a condenser connected to the turbine assembly through at least one of the connecting pipes, the steam from the turbine assembly being condensed into condensate water in the condenser; and a feedwater preheat arrangement comprising at least one injection feedwater heater which is connected to the condenser and the turbine assembly through at least one of the connecting pipes, and comprises:

a main heater body having a heat exchange compartment, a water inlet, a steam inlet, and a water outlet formed on the main heater body; and an injection nozzle provided in the main heater body at a position adjacent to the water inlet, wherein a predetermined amount of the condensate water from the condenser is arranged to be pumped into the main heater body through the water inlet, the condensate water passing through the water inlet being arranged to be injected into the heat exchange compartment through the injection nozzle for creating a negative pressure in the heat exchange compartment, the negative pressure drawing a predetermined amount of steam from the turbine assembly to enter the heat exchange compartment through the steam inlet for mixing with the condensate water, the condensate water being heated up by the steam which is then condensed into water and arranged to be discharged out of the heat exchange compartment through the water outlet.

Another aspect of the present invention provides a steam power generating system, comprising:

a plurality of connecting pipes;

a steam generator arranged to produce a predetermined amount of steam;

a turbine assembly comprising at least one turbine connected to the steam generator through at least one of the connecting pipes, the steam generated by the steam generator being arranged to produce work on the turbine assembly;

an electric generator connected to the turbine assembly, the work produced in the turbine assembly being converted to a predetermined amount of electricity;

a condenser connected to the turbine assembly through at least one of the connecting pipes, the steam from the turbine assembly being condensed into condensate water in the condenser; and a feedwater preheat arrangement provided between the condenser and the steam generator, the feedwater preheat arrangement comprising:

a first injection feedwater heater which comprises:

a first main heater body having a first heat exchange compartment, a first water inlet connected to the condenser, a first steam inlet connected to the turbine assembly, and a first water outlet formed on the first main heater body and connected to the steam generator; and a first injection nozzle provided in the first main heater body at a position adjacent to the first water inlet;

a second injection feedwater heater, which comprises:

a second main heater body having a second heat exchange compartment, a second water inlet connected to the condenser and the first water inlet, a second steam inlet connected to the turbine assembly, and a second water outlet formed on the second main heater body and connected to the steam generator and the first water outlet in parallel; and a second injection nozzle provided in the second main heater body at a position adjacent to the second water inlet; and a third injection feedwater heater, which comprises:

a third main heater body having a third heat exchange compartment, a third water inlet connected to the condenser and the first water inlet and the second water inlet, a third steam inlet connected to the turbine assembly, and a third water outlet formed on the third main heater body and connected to the steam generator and the first water outlet and the second water outlet all in parallel; and a third injection nozzle provided in the third main heater body at a position adjacent to the third water inlet;

the first through third injection feedwater heater being connected in parallel with each other, wherein a predetermined amount of condensate water from the condenser is arranged to be pumped into the first through third main heater body via the first through third water inlet respectively, the condensate water passing through the first through third water inlet being arranged to be injected into the first through third heat exchange compartment via the first through the third injection nozzle respectively for creating a negative pressure in the first heat exchange compartment, the second heat exchange compartment and the third heat exchange compartment, the negative pressure drawing a predetermined amount of steam from the turbine assembly to enter the first through third heat exchange compartment via the first through the third steam inlet for mixing with the condensate water, the condensate water being heated up by the steam which is then condensed into water and arranged to be discharged out of the corresponding first through the third heat exchange compartment via the first through third water outlet.

Another aspect of the present invention provides a steam power generating system, comprising a plurality of connecting pipes;

a steam generator arranged to produce a predetermined amount of steam;

a turbine assembly comprising at least one turbine connected to the steam generator through at least one of the connecting pipes, the steam generated by the steam generator being arranged to produce work on the turbine assembly;

an electric generator connected to the turbine assembly, the work produced in the turbine assembly being converted to a predetermined amount of electricity;

a condenser connected to the turbine assembly through at least one of the connecting pipes, the steam from the turbine assembly being condensed into condensate water in the condenser; and a feedwater preheat arrangement provided between the condenser and the steam generator, the feedwater preheat arrangement comprising:

a deaerator connected to the turbine assembly;

a first injection feedwater heater which comprises:

a first main heater body having a first heat exchange compartment, a first water inlet connected to the condenser, a first steam inlet connected to the turbine assembly, and a first water outlet formed on the first main heater body and connected to the deaerator; and a first injection nozzle provided in the first main heater body at a position adjacent to the first water inlet;

a second injection feedwater heater, which comprises:

a second main heater body having a second heat exchange compartment, a second water inlet connected to the deaerator, a second steam inlet connected to the turbine assembly, and a second water outlet formed on the second main heater body; and a second injection nozzle provided in the second main heater body at a position adjacent to the second water inlet; and a third injection feedwater heater, which comprises:

a third main heater body having a third heat exchange compartment, a third water inlet connected to the second water outlet of the second injection feedwater heater, a third steam inlet connected to the turbine assembly, and a third water outlet formed on the third main heater body and connected to the steam generator; and a third injection nozzle provided in the third main heater body at a position adjacent to the third water inlet;

wherein a predetermined amount of condensate water from the condenser is arranged to sequentially pass through the first injection feedwater heater, the deaerator, the second injection feedwater heater, the third injection feedwater heater, and back to the steam generator;

for the first through third injection feedwater heater, the condensate water being arranged to be pumped into the corresponding first through third main heater body via the first through third water inlet respectively, the condensate water passing through the corresponding first through third water inlet being arranged to be injected into the corresponding first through third heat exchange compartment via the first through the third injection nozzle respectively for creating a negative pressure in the first through third heat exchange compartment, the negative pressure drawing a predetermined amount of steam from the turbine assembly to enter the first through third heat exchange compartment via the first through the third steam inlet for mixing with the condensate water, the condensate water being heated up by the steam which is then condensed into water and arranged to be discharged out of the corresponding first through the third heat exchange compartment via the first through third water outlet.

Another aspect of the present invention provides a steam power generating system, comprising:

a plurality of connecting pipes;

a steam generator arranged to produce a predetermined amount of steam;

a turbine assembly comprising at least one turbine connected to the steam generator through at least one of the connecting pipes, the steam generated by the steam generator being arranged to produce work on the turbine assembly;

an electric generator connected to the turbine assembly, the work produced in the turbine assembly being converted to a predetermined amount of electricity;

a condenser connected to the turbine assembly through at least one of the connecting pipes, the steam from the turbine assembly being condensed into condensate water in the condenser; and a feedwater preheat arrangement provided between the condenser and the steam generator, the feedwater preheat arrangement comprising:

a deaerator connected to the turbine assembly;

a first injection feedwater heater which comprises:

a first main heater body having a first heat exchange compartment, a first water inlet connected to the condenser, a first steam inlet connected to the turbine assembly, and first water outlet formed on the first main heater body and connected to the deaerator; and a first injection nozzle provided in the first main heater body at a position adjacent to the first water inlet;

a second injection feedwater heater, which comprises:

a second main heater body having a second heat exchange compartment, a second water inlet connected to the condenser and the first water inlet in parallel, a second steam inlet connected to the turbine assembly, and a second water outlet formed on the second main heater body and connected to the deaerator and the first water outlet in parallel; and a second injection nozzle provided in the second main heater body at a position adjacent to the second water inlet; and a third injection feedwater heater, which comprises:

a third main heater body having a third heat exchange compartment, a third water inlet connected to the deaerator, a third steam inlet connected to the turbine assembly, and a third water outlet formed on the third main heater body and connected to the steam generator; and a third injection nozzle provided in the third main heater body at a position adjacent to the third water inlet;

a fourth injection feedwater heater, which comprises:

a fourth main heater body having a fourth heat exchange compartment, a fourth water inlet connected to the deaerator and the third water inlet in parallel, a third steam inlet connected to the turbine assembly, and a third water outlet formed on the third main heater body and connected to the steam generator and the third water outlet in parallel; and a fourth injection nozzle provided in the fourth main heater body at a position adjacent to the fourth water inlet;

wherein a predetermined amount of condensate water from the condenser is arranged to be pumped into the first injection feedwater heater and the second injection feedwater heater in parallel, the water coming out of the first injection feedwater heater and the second injection feedwater heater being arranged to enter the deaerator and thereafter guided to enter the third injection feedwater heater and the fourth injection feedwater heater in parallel, the condensate water coming out of the third injection feedwater heater and the fourth injection feedwater heater being arranged to flow back to the steam generator for another cycle of electricity generation;

for the first through fourth injection feedwater heater, the condensate water being arranged to be pumped into the corresponding first through fourth main heater body via the first through fourth water inlet respectively, the condensate water passing through the corresponding first through fourth water inlet being arranged to be injected into the corresponding first through fourth heat exchange compartment via the first through the fourth injection nozzle respectively for creating a negative pressure in the first through fourth heat exchange compartment, the negative pressure drawing a predetermined amount of steam from the turbine assembly to enter the first through fourth heat exchange compartment via the first through the fourth steam inlet for mixing with the condensate water, the condensate water being heated up by the steam which is then condensed into water and arranged to be discharged out of the corresponding first through the fourth heat exchange compartment via the first through fourth water outlet.

Another aspect of the present invention provides a steam power generating system, comprising a plurality of connecting pipes;

a steam generator arranged to produce a predetermined amount of steam;

a turbine assembly comprising at least one turbine connected to the steam generator through at least one of the connecting pipes, the steam generated by the steam generator being arranged to produce work on the turbine assembly;

an electric generator connected to the turbine assembly, the work produced in the turbine assembly being converted to a predetermined amount of electricity;

a condenser connected to the turbine assembly through at least one of the connecting pipes, the steam from the turbine assembly being condensed into condensate water in the condenser; and a feedwater preheat arrangement provided between the condenser and the steam generator, the feedwater preheat arrangement comprising:

a first and a second deaerator connected to the turbine assembly;

a first injection feedwater heater which comprises:

a first main heater body having a first heat exchange compartment, a first water inlet connected to the condenser, a first steam inlet connected to the turbine assembly, and a first water outlet formed on the first main heater body and connected to the first deaerator; and a first injection nozzle provided in the first main heater body at a position adjacent to the first water inlet;

a second injection feedwater heater, which comprises:

a second main heater body having a second heat exchange compartment, a second water inlet connected to the condenser and the first water inlet in parallel, a second steam inlet connected to the turbine assembly, and a second water outlet formed on the second main heater body and connected to the second deaerator; and a second injection nozzle provided in the second main heater body at a position adjacent to the second water inlet; and a third injection feedwater heater, which comprises:

a third main heater body having a third heat exchange compartment, a third water inlet connected to the first deaerator, a third steam inlet connected to the turbine assembly, and a third water outlet formed on the third main heater body; and a third injection nozzle provided in the third main heater body at a position adjacent to the third water inlet;

a fourth injection feedwater heater, which comprises:

a fourth main heater body having a fourth heat exchange compartment, a fourth water inlet connected to the second deaerator, a fourth steam inlet connected to the turbine assembly, and a fourth water outlet formed on the fourth main heater body; and a fourth injection nozzle provided in the fourth main heater body at a position adjacent to the fourth water inlet;

a fifth injection feedwater heater, which comprises:

a fifth main heater body having a fifth heat exchange compartment, a fifth water inlet connected to the third water outlet, a fifth steam inlet connected to the turbine assembly, and a fifth water outlet formed on the fifth main heater body and connected to the steam generator;

a fifth injection nozzle provided in the fifth main heater body at a position adjacent to the fifth water inlet;

a sixth injection feedwater heater, which comprises:

a sixth main heater body having a sixth heat exchange compartment, a sixth water inlet connected to the fourth water outlet, a sixth steam inlet connected to the turbine assembly, and a sixth water outlet formed on the sixth main heater body and connected to the steam generator and the fifth water outlet in parallel; and a sixth injection nozzle provided in the sixth main heater body at a position adjacent to the sixth water inlet;

wherein a predetermined amount of condensate water from the condenser is arranged to be pumped into the first injection feedwater heater and the second injection feedwater heater in parallel, the water coming out of the first injection feedwater heater and the second injection feedwater heater being arranged to enter the first deaerator and the second deaerator respectively, the condensate water coming out from the first deaerator being arranged to sequentially enter the third injection feedwater heater and the fifth injection feedwater heater, the condensate water coming out from the second deaerator being arranged to sequentially enter the fourth injection feedwater heater and the sixth injection feedwater heater, the condensate water coming out of the fifth injection feedwater heater and the sixth injection feedwater heater being arranged to flow back to the steam generator for another cycle of electricity generation;

for the first through sixth injection feedwater heater, the condensate water being arranged to be pumped into the corresponding first through sixth main heater body via the first through sixth water inlet respectively, the condensate water passing through the corresponding first through sixth water inlet being arranged to be injected into the corresponding first through sixth heat exchange compartment via the first through the sixth injection nozzle respectively for creating a negative pressure in the first through sixth heat exchange compartment, the negative pressure drawing a predetermined amount of steam from the turbine assembly to enter the first through sixth heat exchange compartment via the first through the sixth steam inlet for mixing with the condensate water, the condensate water being heated up by the steam which is then condensed into water and arranged to be discharged out of the corresponding first through the sixth heat exchange compartment via the first through sixth water outlet.

Another aspect of the present invention provides an injection feedwater heater for a steam power generating system comprising a steam generator, a turbine assembly, an electric generator and a condenser, the injection feedwater heater comprising:

a main heater body having a heat exchange compartment, a water inlet, a steam inlet, and a water outlet formed on the main heater body; and an injection nozzle provided in the main heater body at a position adjacent to the water inlet, wherein a predetermined amount of condensate water is arranged to be pumped into the main heater body through the water inlet, the condensate water passing through the water inlet being arranged to be injected into the heat exchange compartment through the injection nozzle for creating a negative pressure in the heat exchange compartment, the negative pressure drawing a predetermined amount of steam to enter the heat exchange compartment through the steam inlet for mixing with the condensate water, the condensate water being heated up by the steam which is then condensed into water and arranged to be discharged out of the heat exchange compartment through the water outlet.

This summary presented above is provided merely to introduce certain concepts and not to identify any key or essential features of the claimed subject matter.

DETAILED DESCRIPTION OF THE PREFERRED EMBODIMENT

Figure 1:
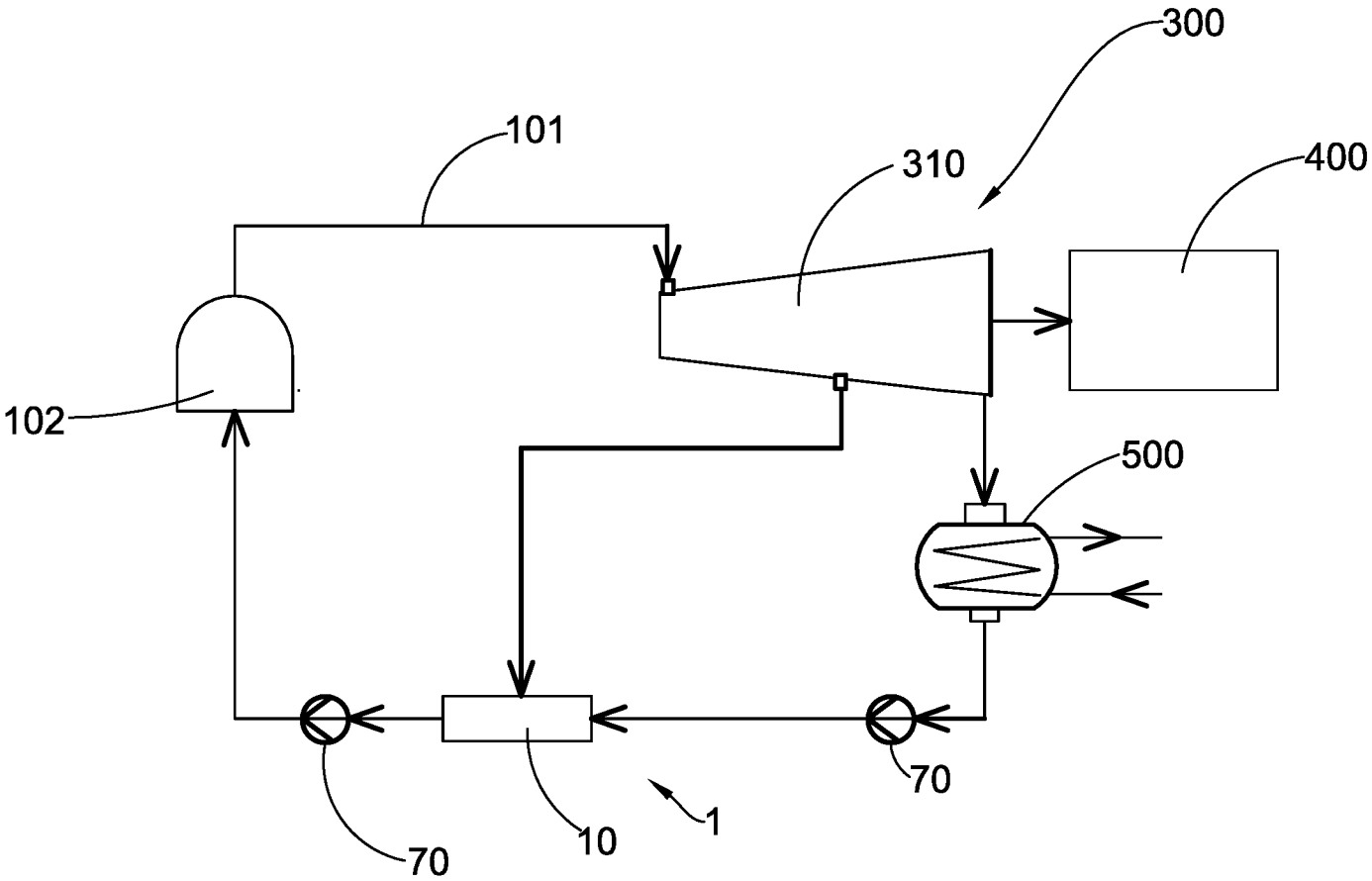
FIG. 1 is a schematic diagram of a steam power generating system according to a first preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 7 of the drawings, a steam power generating system according a first preferred embodiment of the present invention is illustrated. Broadly, the steam power generating system may comprise a plurality of connecting pipes 101, a steam generator 102, a turbine assembly 300, an electric generator 400, a condenser 500, and a feedwater preheat arrangement 1 which comprises at least one injection feedwater heater 10.

The connecting pipes 101 may connect one of more components in the steam power generating system and may allow steam or water to pass therethrough. The steam generator 102 may be arranged to produce a predetermined amount of steam. The steam generator 102 may be configured as a boiler.

The turbine assembly 300 may comprise at least one turbine 310 and may be connected to the steam generator 102 through at least one of the connecting pipes 101, wherein the steam generated by the steam generator 102 may be arranged to feed into and produce work on the turbine assembly 300.

The electric generator 400 may be connected to the turbine assembly 300, wherein the work produced in the turbine assembly 300 may be converted to a predetermined amount of electricity through turning the turbine 310.

The condenser 500 may be connected to the turbine assembly 300 through at least one of the connecting pipes 101, wherein the steam from the turbine assembly 300 may be guided to flow into the condenser 500 which may be arranged to condense the steam into condensate water.

The injection feedwater heater 10 may be connected to the condenser 500 and the turbine assembly 300 through at least one of the connecting pipes 101, and may comprise a main heater body 11 and an injection nozzle 12.

The main heater body 11 may have a heat exchange compartment 111, a water inlet 112, a steam inlet 113, and a water outlet 114 formed on the main heater body 11.

The injection nozzle 12 may be provided in the main heater body 11 at a position adjacent to the water inlet 112, wherein a predetermined amount of the condensate water from the condenser 500 may be arranged to be pumped into the main heater body 11 through the water inlet 112. The condensate water passing through the water inlet 112 may be arranged to be injected into the heat exchange compartment 111 through the injection nozzle 12 for creating a negative pressure in the heat exchange compartment 111. The negative pressure may then draw a predetermined amount of steam from the turbine assembly 300 to enter the heat exchange compartment 111 through the steam inlet 113 for mixing with the condensate water. The condensate water may be heated up by the steam which is then condensed into water and arranged to be discharged out of the heat exchange compartment 111 through the water outlet 114.

Thus, the feedwater preheat arrangement 1 may be provided between the steam generator 102 and the condenser 500 for preheating the condensate water from the condenser 500 before feeding to the steam generator 102.

According to the first preferred embodiment of the present invention, the steam power generating system may operate in accordance with thermodynamics theories, such as following the heat exchange model predicted by Rankine cycle. The connecting pipes 101 may connect each of the elements of the steam power generating system which may be employed in a steam power plant. The steam generator 102 may be configured as a boiler which may heat up water by using a predetermined type of fuel. The water may be converted into superheated steam which may be guided to flow to the turbine assembly 300.

The turbine assembly 300 may comprise at least one turbine 310 arranged in such a manner that the superheated steam produced by the steam generator 102 may be allowed to turn the turbine 310 for converting heat energy into mechanical energy. More than one turbine 310 may be employed according to different circumstances in which the present invention is utilized.

The electric generator 400 may be connected to the turbine assembly 300 and may be arranged to convert mechanical energy into electrical energy when the turbine 310 is turned. The electric generator 400 may be connected to other electrical components so that people may make further use of the electricity generated by the electric generator 400.

The condenser 500 may be connected to the turbine assembly 300 wherein the steam used to turn the turbine 310 may be guided to flow into the condenser 500. The steam flowing into the condenser 500 may be arranged to perform heat exchange with a predetermined heat exchange medium (such as water) so as to be condensed back into water (referred to "condensate water in this specification). Heat may be extracted from the steam, and condensate water may be arranged to flow out of the condenser 500. The condensate water may be preheated by at least one injection feedwater heater 10 before being circulated back to the steam generator 102.

The steam power generating system may further comprise at least one pumping device 70 connected to at least one of the connecting pipes 101 for pumping fluid flowing through the various components of the steam power generating system. In the first preferred embodiment, the steam power generating system may comprise two pumping devices 70 one of which may be connected between the injection feedwater heater 10 and the condenser 500, while the other one may be connected between the injection feedwater heater 60 and the steam generator 102. The pumping devices 70 may facilitate circulation of the condensate water from the condenser 500 to the steam generator 102.

The injection feedwater heater 10 may be connected to the condenser 500 and the turbine assembly 300 so that the water coming out from the condenser 500 may be guided to flow into the injection feedwater heater 10. At the same time, steam from the turbine assembly 300 may be guided to flow into the injection feedwater heater 60 to perform heat exchange with the condensate water.

Figure 2:
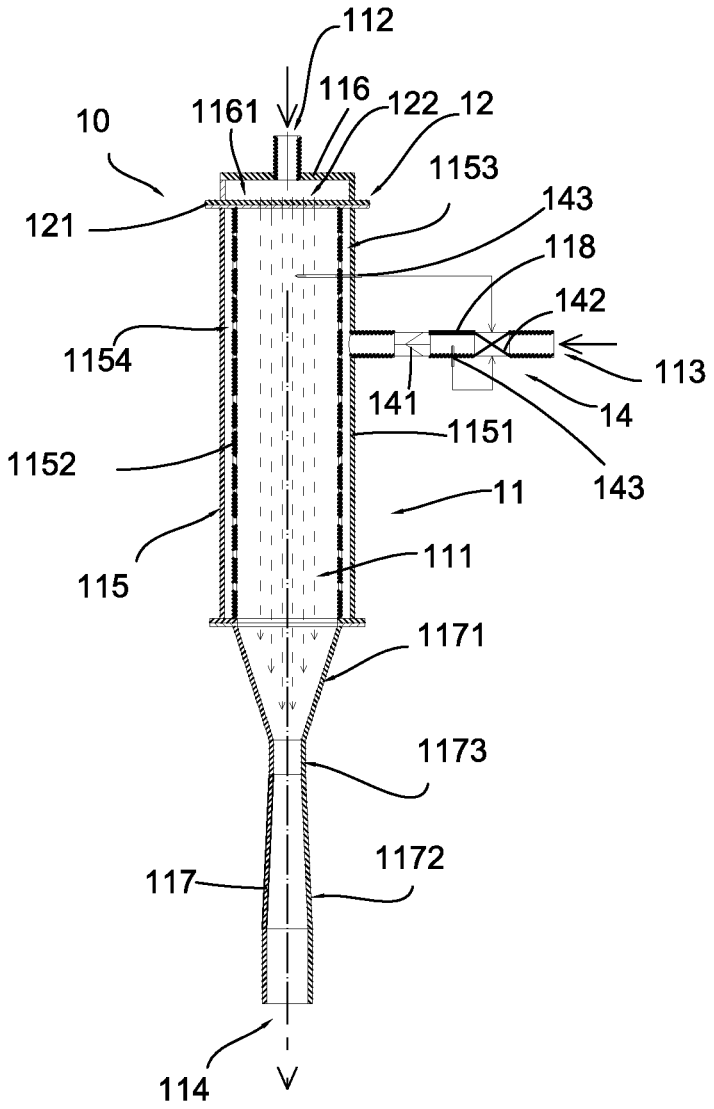
FIG. 2 is a schematic view of an injection feedwater heater according to the first preferred embodiment of the present invention.

Specifically, the water inlet 112 may be connected to the condenser 500 through at least one connecting pipe 101. The condensate water coming from the condenser 500 may be guided to flow into the injection feedwater heater 10 through the water inlet 112. In the first preferred embodiment of the present invention, the main heater body 11 may comprise a heat exchanging tube 115 and a water collection head 116 connected to the heat exchanging tube 115, wherein the water inlet 112 may be formed on the water collection head 116 while the heat exchange compartment 111 may be formed in the heat exchanging tube 115. The heat exchanging tube 115 may be configured as having an elongated structure and may be installed in vertical orientation. In this orientation, the water collection head 116 may be provided on top of the heat exchanging tube 115, as shown in FIG. 2 of the drawings.

The main heater body 11 may further comprise a water discharging tube 117 extended from the heat exchanging tube 115, wherein the water outlet 114 may be formed on the water discharging tube 117. Condensate water coming from the condenser 500 may sequentially pass through the water inlet 112, the water collection head 116, the heat exchanging tube 115, the water discharging tube 117, and the water outlet 114. As shown in FIG. 2 of the drawings, the water collection head 116 and the water discharging tube 117 may be provided on two opposite ends of the heat exchanging tube 115 respectively. Thus, when in vertical orientation, the water discharging tube 117 may be provided below the heat exchanging tube 115.

Figure 3:
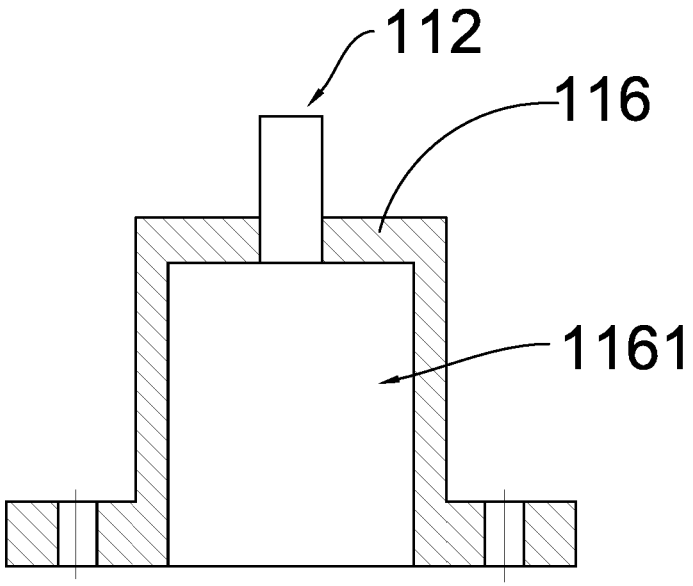
FIG. 3 is a schematic diagram of a water collection head according to the first preferred embodiment of the present invention.
Figure 4:
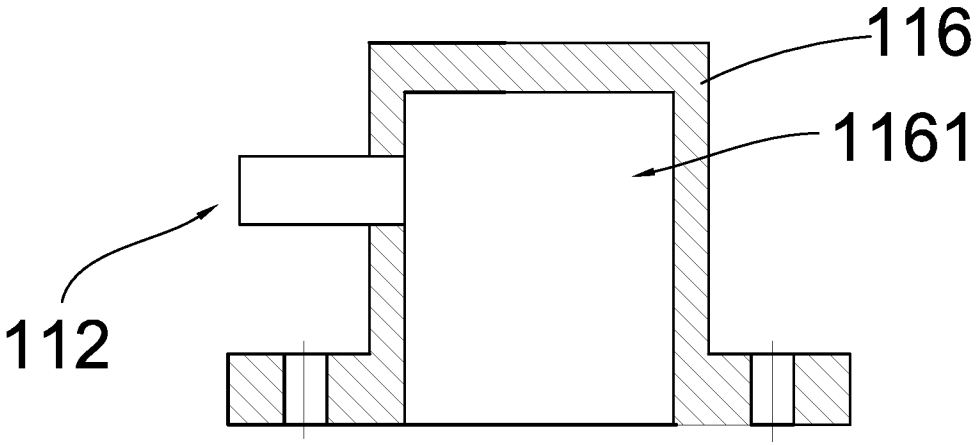
FIG. 4 is an alternative configuration of the water collection head according to the first preferred embodiment of the present invention.

Referring to FIG. 3 of the drawings, the water collection head 116 may have a water collection chamber 1161. The water inlet 112 may be formed on the water collection head 116 and may communicate with the water collection chamber 1161. Condensate water from the condenser 500 may pass through the water inlet 112 and may be temporarily accommodated in the water collection chamber 1161 before passing through the injection nozzle 12. Note that the water inlet 112 may be formed along a longitudinal axis of the heat exchanging tube 115 so as to substantially align therewith. Alternatively, the water inlet 112 may be formed substantially parallel to a transverse axis of the heat exchanging tube 115, as shown in FIG. 4 of the drawings.

The heat exchanging tube 115 may comprise an external tube member 1151 and an internal tube member 1152 for forming a double wall structure of the heat exchanging tube 115. The steam inlet 113 may be formed on the external tube member 1151 of the heat exchanging tube 115. A diameter of the internal tube member 1152 may be less than that of the external tube member 1151 so as to form a receiving gap 1153 between the external tube member 1151 and the internal tube member 1152. The heat exchange compartment 111 may be formed inside the internal tube member 1152.

Furthermore, the internal tube member 1152 may have a plurality of holes 1154 formed thereon for communicating the receiving gap 1153 with the heat exchange compartment 111. Thus, steam from the turbine 310 may enter the heat exchanging tube 115 through the steam inlet 113. The steam passing through the steam inlet 113 may be temporarily accommodated in the receiving gap 1153 and may eventually be guided to enter the heat exchange compartment 111 through the holes 1154. In this preferred embodiment, each of the external tube member 1151 and the internal tube member 1152 may have a circular cross section. Other cross-sectional shapes may also be possible and should be covered and protected by the present patent. Similarly, each of the external tube member 1151 and the internal tube member 1152 may have a uniform diameter along a longitudinal axis thereof. However, non-uniform diameter along the longitudinal axis of each or both of the external tube member 1151 and the internal tube member 1152 may also be possible.

Figure 5:
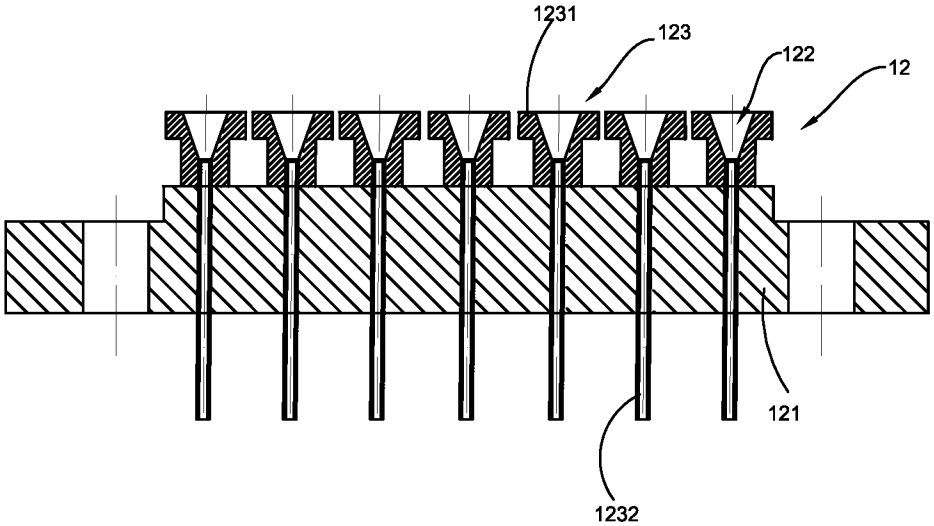
FIG. 5 is a sectional schematic view of an injection nozzle according to the first preferred embodiment of the present invention.

As shown in FIGS. 2 and 5 of the drawings, the injection nozzle 12 may be provided between the water collection head 116 and the heat exchanging tube 115. The injection nozzle 12 may comprise a nozzle base 121 and have a plurality of injection holes 122 formed on the nozzle base 121, wherein the injection holes 122 may communicate the water collection chamber 1161 with the heat exchange compartment 111 so that water collected in the water collection chamber 1161 may be injected into the heat exchange compartment 111 through the injection holes 122.

Figure 6:
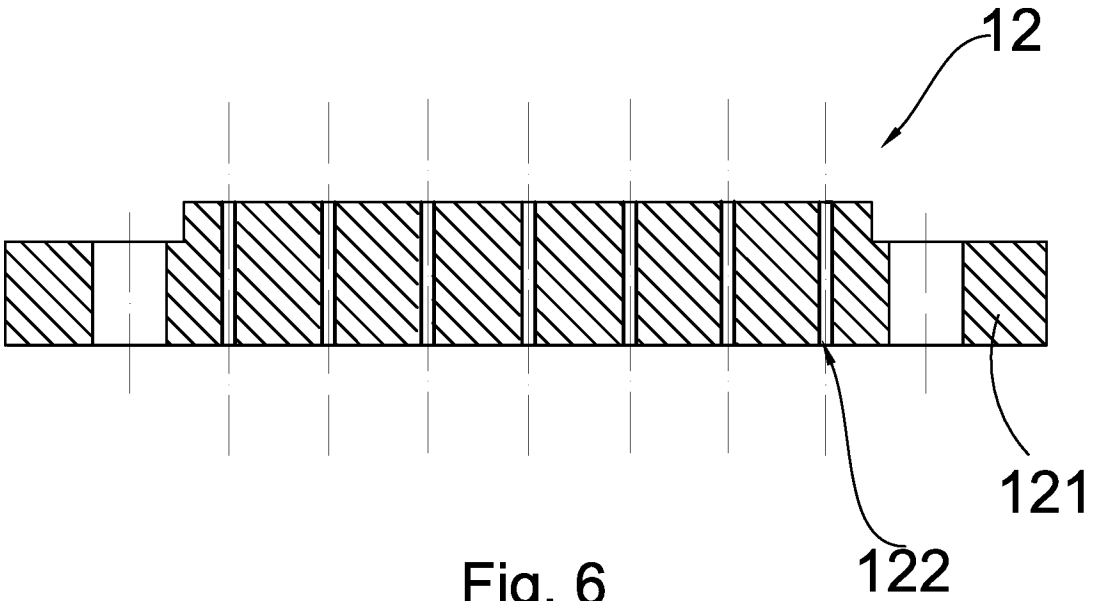
FIG. 6 is an alternative configuration of an injection nozzle according to the first preferred embodiment of the present invention.

The two different configurations of the injection nozzle 12 may be illustrated in FIG. 5 and FIG. 6 of the drawings. As shown in FIG. 5 of the drawings, the injection nozzle 12 may further comprise a plurality of nozzle units 123 wherein the injection holes 122 may be formed in the nozzle units 123 respectively. Each of the nozzle units 123 may have a nozzle head 1231 provided on the nozzle base 121, and an elongated nozzle pin 1232 extending from the nozzle head 1231 and penetrating through the nozzle base 121, wherein the corresponding injection hole 122 may extend along the nozzle head 1231 and the elongated nozzle pin 1232. The injection hole 122 extending in the nozzle head 1231 may have a tapered cross-sectional shape.

Alternatively, as shown in FIG. 6 of the drawings, the injection holes 122 may be formed directly on the nozzle base 121 so that water collection in the water collection chamber 1161 may be injected into the heat exchange compartment 111 through the injection holes 122 without passing through any nozzle units 123.

Figure 7:
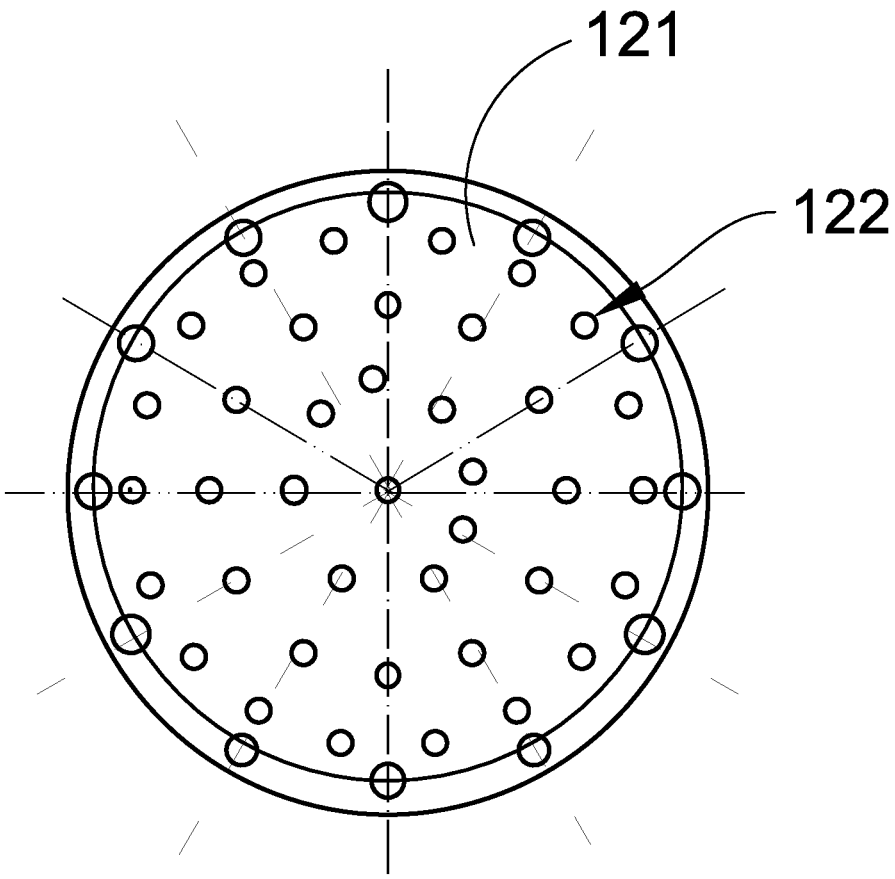
FIG. 7 is a top schematic view of nozzle holes forming on a nozzle base according to the first preferred embodiment of the present invention.
Figure 8:
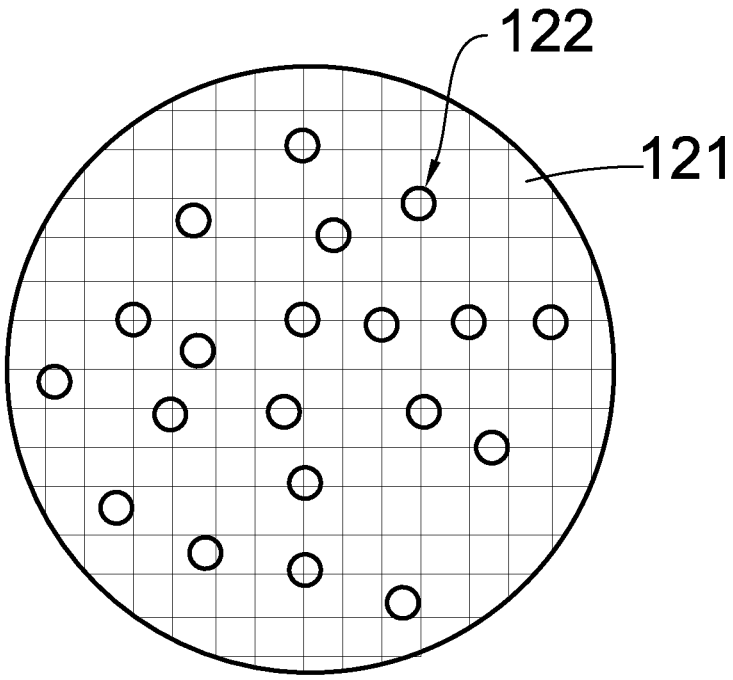
FIG. 8 is an alternative configuration of nozzle holes forming on the nozzle base according to the first preferred embodiment of the present invention.

Referring to FIG. 7 to FIG. 8 of the drawings, the nozzle base 121 may be configured to have a substantially circular cross section wherein the injection holes 122 may be spacedly formed on the nozzle base 121. The exact distribution of the injection holes 122 or the injection units 123 forming on the nozzle base 121 may vary depending on the manufacturing or application circumstances of the case. For example, FIG. 7 illustrates a radial projection of the nozzle holes 122 from the center of the nozzle base 121. Thus, the nozzle holes 122 may be distributed on the nozzle base 121 along several imaginary projection lines radially extended from the center of the nozzle base 121. In the case where nozzle units 123 are used, the nozzle units 123 may be distributed on the nozzle base 121 along several imaginary projection lines radially extended from the center of the nozzle base 121.

As another example, FIG. 8 illustrates that the nozzle holes 122 may be distributed on the nozzle base 121 randomly. The exact manner in which the nozzle holes 122 may be distributed depend on the manufacturing and operational circumstances of the present invention.

The water discharging tube 117 may extend from the heat exchanging tube 115 at a position opposite to the water collection head 116. Thus, the water collection head 116 and the water discharging tube 117 may be provided on two opposite end portions of the heat exchanging tube 115 respectively. As shown in FIG. 2 of the drawings, the water discharging tube 115 may extend from the internal tube member 1152 of the heat exchanging tube 115.

The water discharging tube 117 may have a guiding portion 1171, a pressurizing portion 1172, and a buffering portion 1173 extended between the guiding portion 1171 and the pressurizing portion 1172. The guiding portion 1171 may extend from the heat exchanging tube 115 and may have a diameter gradually decreasing from the heat exchanging tube 115 so as to form a tapered cross-section shape for collecting and guiding water flow in the guiding portion.

The pressurizing portion 1172 may extend from the buffering portion 1173 and may have a diameter gradually increasing from the buffering portion 1173 so that the water passing through the pressurizing portion 1172 may have increasing pressure but decreasing flow rate.

The injection feedwater heater 10 may further comprise a safety arrangement 14 provided on the heat exchanging tube 115 for preventing fluid, such as condensate water, from exiting the heat exchanging tube 115 and reaching the turbine 310 through the steam inlet 113.

To accommodate the safety arrangement 14, the main heater body 11 may further comprise a steam input tube 118 extending from the external tube member 1151, wherein the steam inlet 113 may be formed in the steam input tube 118. Thus, steam coming from the turbine 310 may flow into the heat exchanging tube 115 through the steam input tube 118 and the steam inlet 113. On the other hand, the safety arrangement 14 may comprise a unidirectional valve 141 mounted in the steam input tube 118 for preventing water from exiting the heat exchanging tube 115 and reaching the turbine 310 through the steam inlet 113.

The safety arrangement 14 may further comprise an electromagnetic valve 142 mounted in the steam input tube 118, and a plurality of pressure sensors 143 provided in the internal tube member 1152 and the steam input tube 118 respectively for measuring the pressure in the internal tube member 1152 (i.e. the heat exchange compartment 111) and the steam input tube 118 respectively. The pressure sensors 143 may be electrically connected to the electromagnetic valve 142 so that when the pressure sensors 143 detect that the pressure in the steam input tube 118 is lower than that of the heat exchange compartment 111, the electromagnetic valve 142 may be arranged to turn off the corresponding pumping device 70 for stopping condensate water from further feeding into the injection feedwater heater 10.

The operation of the present invention is as follows: the steam power generating system may be utilized to generate electricity through applications of thermodynamics theories such as Rankin cycle. Water in the steam generator 102 may be heated to become superheated steam. The superheated steam may be guided to flow to the turbine assembly 300 so that the energy stored in the superheated steam may be used to turn one or more turbine 310. The movement of the turbines 310 may be used to generate electricity by the electric generator 400.

The steam leaving the turbine assembly 300 may be guided to flow into the condenser 500 which may condense the steam into condensate water. The condensate water may then be guided to leave the condenser 500 and enter the injection feedwater heater 10. The purpose of feeding the water into the injection feedwater heater 10 is to preheat the condensate water to a predetermined temperature by using the heat from the steam extracted from the turbine assembly 300 so as to maximize the overall efficiency of the entire steam power generating system. The condensate water may then be guided to leave the injection feedwater heater 10 and flow back to the steam generator 102 for being converted back into superheated steam to perform another cycle of electricity generation in the manner described above.

In the injection feedwater heater 10, condensate water may first be fed into the water collection head 116 through the water inlet 112. The condensate water may then be temporarily collected in the water collection chamber 1161 and ready to pass through the injection nozzle 12. The condensate water in the water collection chamber 1161 may then be injected into the heat exchange compartment 111 by the injection nozzle 12. The injection of the condensate water in the heat exchange compartment 111 may create a negative pressure in the heat exchange compartment 111 which may tend to create a suction effect to the fluid staying out of the heat exchange compartment 111. As a result, steam may be sucked into the heat exchanging tube 115 through the steam inlet 113. The steam passing through the steam inlet 113 may go on to pass through the holes 1154 and eventually enter the heat exchange compartment 111. The steam entering the heat exchange compartment 111 may be arranged to mix with the condensate water and perform heat exchange therewith. The result is that the condensate water may be "pre-heated" while the steam may be condensed in the heat exchange compartment 111 after performing heat exchange with the condensate water.

The resulting product which is also water may be guided to sequentially pass through the guiding portion 1171, the buffering portion 1173 and the pressurizing portion 1172 of the water discharging tube 117. The water passing through the water discharging tube 117 may be guided to leave the injection feedwater heater 10 through the water outlet 114. The water leaving the injection feedwater heater 10 may be guided to flow back to the steam generator 102 in the manner described above.

Figure 9:
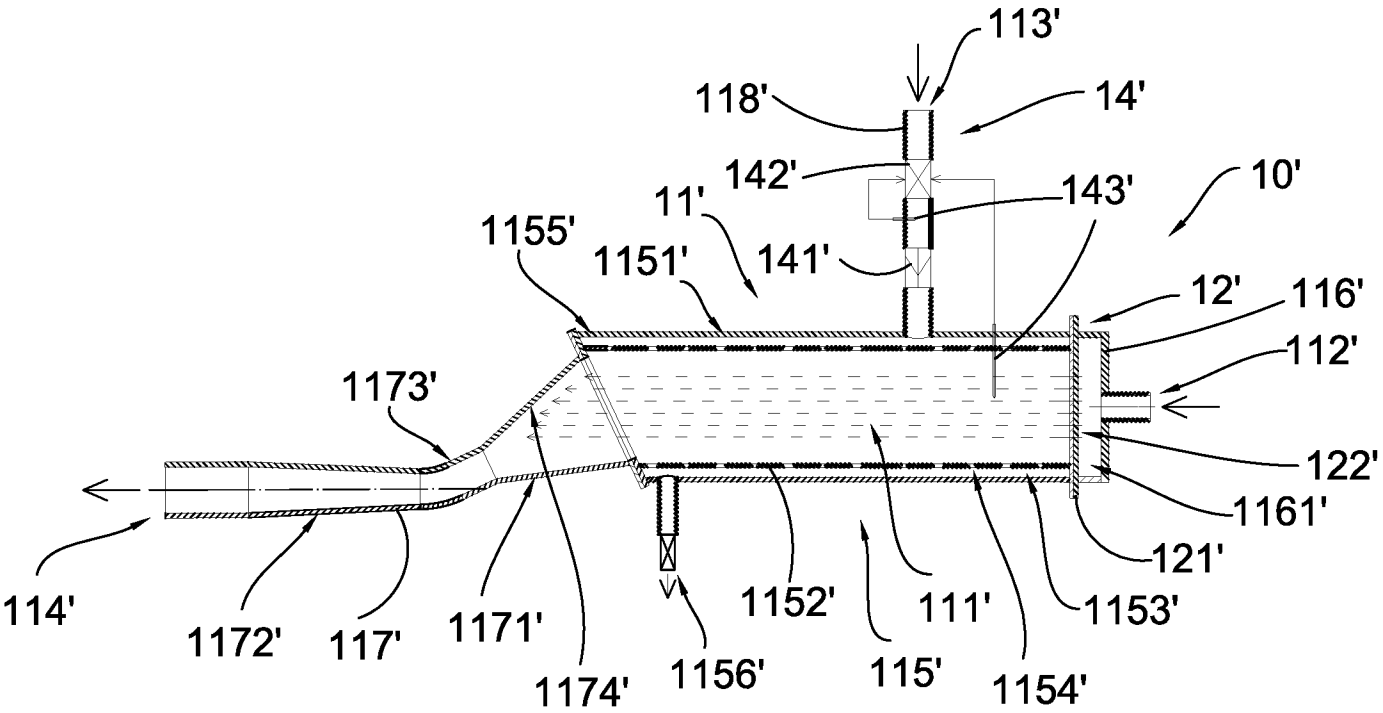
FIG. 9 is a schematic diagram of a first alternative mode of the injection feedwater heater according to the first preferred embodiment of the present invention.

Referring to FIG. 9 of the drawings, a first alternative mode of the injection feedwater heater 10' according to the first preferred embodiment of the present invention is illustrated. The first alternative mode is similar to the injection feedwater heater 10 described above, except that the injection feedwater heater 10' may be designed primarily for use in a horizontal orientation.

In the first alternative mode, the main heater body 11' may comprise a heat exchanging tube 115' and a water collection head 116' connected to the heat exchanging tube 115', wherein the water inlet 112' may be formed on the water collection head 116' while the heat exchange compartment 111' may be formed in the heat exchanging tube 115'. The heat exchanging tube 115' may also be configured as having an elongated structure.

The main heater body 11' may further comprise a water discharging tube 117' extended from the heat exchanging tube 115', wherein the water outlet 114' may be formed on the water discharging tube 117'. Condensate water coming from the condenser 500 may sequentially pass through the water inlet 112', the water collection head 116', the heat exchanging tube 115', the water discharging tube 117', and the water outlet 114'. As shown in FIG. 9 of the drawings, the water collection head 116' and the water discharging tube 117' may be provided on two opposite ends of the heat exchanging tube 115' respectively. Moreover, one end portion 1155' of the heat exchanging tube 115' may be inclined with respect to longitudinal axis thereof.

As in the first preferred embodiment, the water collection head 116' may have a water collection chamber 1161'. The water inlet 112' may be formed on the water collection head 116' and may communicate with the water collection chamber 1161'. The water inlet 112' may be formed along a longitudinal axis of the heat exchanging tube 115' so as to substantially align therewith.

The heat exchanging tube 115' may comprise an external tube member 1151' and an internal tube member 1152' for forming a double wall structure of the heat exchanging tube 115'. The steam inlet 113' may be formed on the external tube member 1151' of the heat exchanging tube 115'. A diameter of the internal tube member 1152' may be less than that of the external tube member 1151' so as to form a receiving gap 1153' between the external tube member 1151' and the internal tube member 1152'. The heat exchange compartment 111' may be formed inside the internal tube member 1152'.

Furthermore, the internal tube member 1152' may have a plurality of holes 1154' formed thereon for communicating the receiving gap 1153' with the heat exchange compartment 111'. The heat exchanging tube 115' may further have a water release port 1156' formed on the external tube member 1151' for allowing residual water to be discharged out of the receiving gap 1153'.

Again, the injection nozzle 12' may be provided between the water collection head 116' and the heat exchanging tube 115'. The injection nozzle 12' comprise a nozzle base 121' and have a plurality of injection holes 122' formed on the nozzle base 121', wherein the injection holes 122' may communicate the water collection chamber 1161' with the heat exchange compartment 111' so that water collected in the water collection chamber 1161' may be injected into the heat exchange compartment 111' through the injection holes 122'.

The water discharging tube 117' may also extend from the heat exchanging tube 115' at a position opposite to the water collection head 116'. The water discharging tube 117' may extend from the internal tube member 1152' of the heat exchanging tube 115'.

The water discharging tube 117' may have a guiding portion 1171', a pressurizing portion 1172', and a buffering portion 1173' extended between the guiding portion 6171' and the pressurizing portion 1172'. The guiding portion 1171' may extend from the heat exchanging tube 115' and may have a diameter gradually decreasing from the heat exchanging tube 115' so as to form a tapered cross-section shape for collecting and guiding water flow in the guiding portion.

Note that in this first alternative mode, the guiding portion 1171' may have an inclined guiding surface 1174' wherein the water coming from the heat exchanging tube 115' may be arranged to hit the inclined guiding surface 1174' and be guided to flow to the buffering portion 1173'.

The pressurizing portion 1172' may extend from the buffering portion 1173' and may have a diameter gradually increasing from the buffering portion 1173' so that the water passing through the pressurizing portion 1172' may have increasing pressure but decreasing flow rate.

The injection feedwater heater 10' may further comprise a safety arrangement 14' provided on the heat exchanging tube 115' for preventing fluid, such as condensate water, from exiting the heat exchanging tube 115' and reaching the turbine 310 through the steam inlet 113'. As in the preferred embodiment, the main heater body 11' may further comprise a steam input tube 118' extending from the external tube member 1151', wherein the steam inlet 113' is formed in the steam input tube 118'. Thus, steam coming from the turbine 310 may flow into the heat exchanging tube 115' through the steam input tube 118' and the steam inlet 113'. On the other hand, the safety arrangement 14' may comprise a unidirectional valve 141' mounted in the steam input tube 118' for preventing water from exiting the heat exchanging tube 115' and reaching the turbine 310 through the steam inlet 113'.

The safety arrangement 14' may further comprise an electromagnetic valve 142' mounted on the steam inlet 113', and a plurality of pressure sensors 143' provided in the internal tube member 1152' and the steam input tube 118' respectively for measuring the pressure in the internal tube member 1152' and the steam input tube 118' respectively. The operation of the safety arrangement 14' is the same as that mentioned in the preferred embodiment above.

Figure 10:
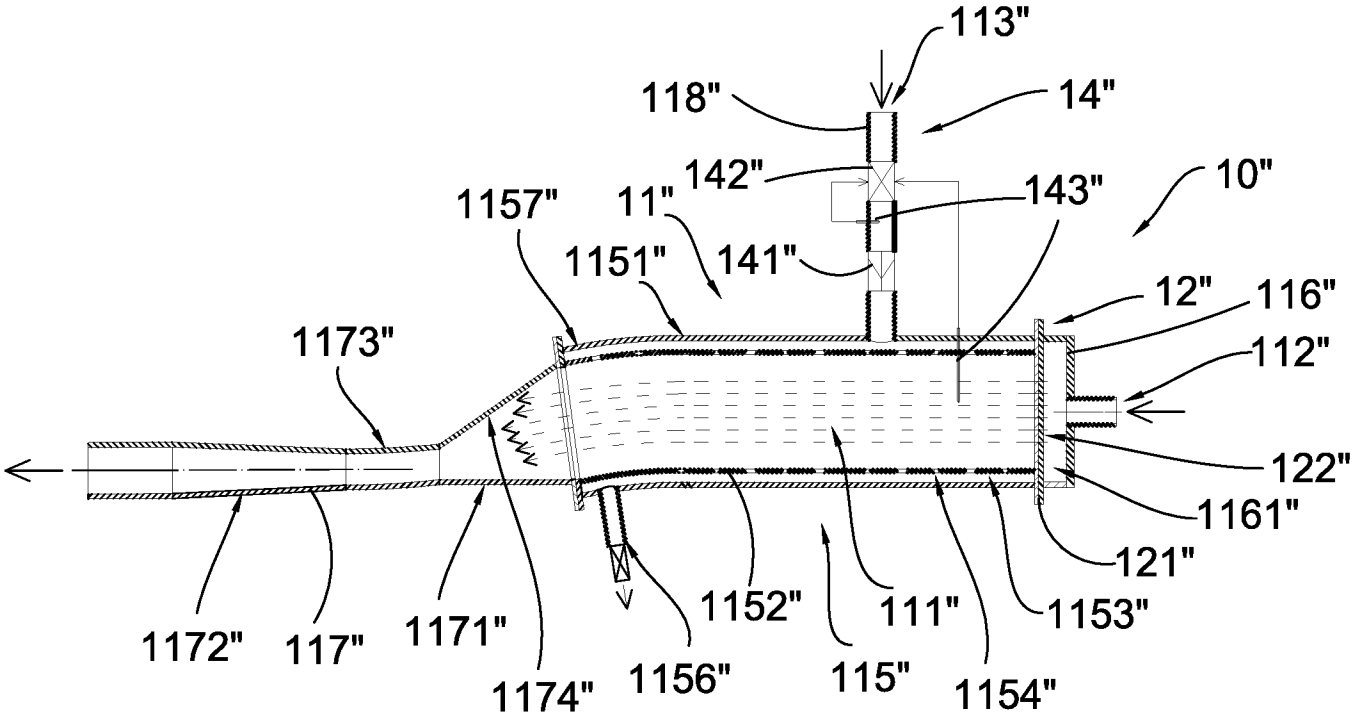
FIG. 10 is a schematic diagram of a second alternative mode of the injection feedwater heater according to the first preferred embodiment of the present invention.

Referring to FIG. 10 of the drawings, a second alternative mode of the injection feedwater heater 60" according to the preferred embodiment of the present invention is illustrated. The second alternative mode is similar to the injection feedwater heater 10' described in the first alternative mode, except that the heat exchanging tube 115" of the injection feedwater heater 10" may have a curved portion 1157" formed adjacent to the guiding portion 1171" of the water discharging tube 117".

The water discharging tube 117" may have a guiding portion 1171", a pressurizing portion 1172", and a buffering portion 1173" extended between the guiding portion 1171" and the pressurizing portion 1172". The guiding portion 1171" may extend from the heat exchanging tube 115" and may have a diameter gradually decreasing from the heat exchanging tube 115" so as to form a tapered cross-section shape for collecting and guiding water flow in the guiding portion. In this second alternative mode, the guiding portion 1171" may also have an inclined guiding surface 1174" wherein the water coming from the heat exchanging tube 115" may be arranged to hit the inclined guiding surface 1174" and be guided to flow to the buffering portion 1173".

The pressurizing portion 1172" may extend from the buffering portion 1173" and may have a diameter gradually increasing from the buffering portion 1173" so that the water passing through the pressurizing portion 1172" may have increasing pressure but decreasing flow rate.

The injection feedwater heater 12" may further comprise a safety arrangement 14" provided on the heat exchanging tube 115" for preventing fluid, such as condensate water, from exiting the heat exchanging tube 115" and reaching the turbine 310 through the steam inlet 113". As in the preferred embodiment, the main heater body 11" may further comprise a steam input tube 118" extending from the external tube member 1151", wherein the steam inlet 113" may be formed in the steam input tube 118". On the other hand, the safety arrangement 14" may comprise a unidirectional valve 141" mounted in the steam input tube 118" for preventing water from exiting the heat exchanging tube 115" and reaching the turbine 310 through the steam inlet 113".

The safety arrangement 14" may further comprise an electromagnetic valve 142" mounted on the steam inlet 113", and a plurality of pressure sensors 143" provided in the internal tube member 1152" and the steam input tube 118" respectively for measuring the pressure in the internal tube member 1152" and the steam input tube 118" respectively. The operation of the safety arrangement 14" is the same as that mentioned in the preferred embodiment and the first alternative mode above.

The injection feedwater heater 10" may also comprise a water collection head 116" having a water collection chamber 1161". The water inlet 112" may be formed on the water collection head 116" and may communicate with the water collection chamber 1161". The water inlet 112" may be formed along a longitudinal axis of the heat exchanging tube 115" so as to substantially align therewith.

Moreover, the steam inlet 113" may be formed on the external tube member 1151" of the heat exchanging tube 115". A diameter of the internal tube member 1152" may be less than that of the external tube member 1151" so as to form a receiving gap 1153" between the external tube member 1151" and the internal tube member 1152". The heat exchange compartment 111" may be formed inside the internal tube member 1152".

Furthermore, the internal tube member 1152" may have a plurality of holes 1154" formed thereon for communicating the receiving gap 1153" with the heat exchange compartment 111". The heat exchanging tube 115" may further have a water release port 1156" formed on the external tube member 1151" for allowing residual water to be discharged out of the receiving gap 1153".

The injection nozzle 12" may be provided between the water collection head 116" and the heat exchanging tube 115". The injection nozzle 12" comprise a nozzle base 121" and have a plurality of injection holes 122" formed on the nozzle base 121".

Figure 11:
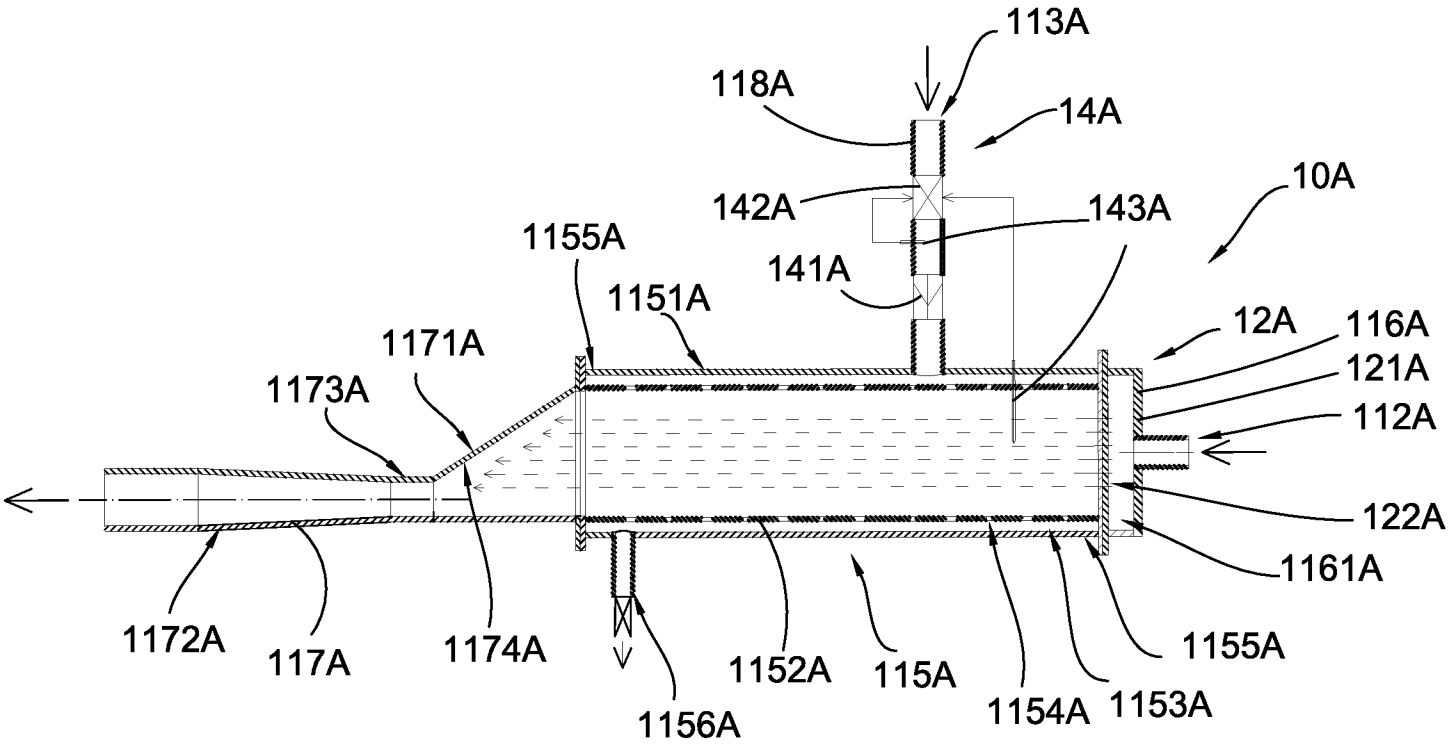
FIG. 11 is a schematic diagram of a third alternative mode of the injection feedwater heater according to the first preferred embodiment of the present invention.

Referring to FIG. 11 of the drawings, a third alternative mode of the injection feedwater heater 10A according to the first preferred embodiment of the present invention is illustrated. The third alternative mode is structurally identical to the injection feedwater heater 10' described in the first alternative mode, except that the both ends 1155A of the heat exchanging tube 115A may not be inclined with respect to longitudinal axis thereof.

Moreover, in this third alternative mode, the inclined guiding surface 1174A may also be formed in the guiding portion 1171A of the water discharging tube 117A. Water passing through the guiding portion 1171A may sequentially pass through the buffering portion 1173A and the pressurizing portion 1172A.

The water release port 1156A may be formed on the external tube member 1151A for allowing residual water to be discharged out of the receiving gap 1153A, which is formed between the external tube member 1151A and the internal tube member 1152A. The holes 1154A may be formed on the internal tube member 1152A. Moreover, the injection nozzle 12A may be provided between the water collection head 116A and the heat exchanging tube 115A. The injection nozzle 12A may comprise a nozzle base 121A and have a plurality of injection holes 122A formed on the nozzle base 121A. The water collection chamber 1161A may communicate with the water inlet 112A.

The safety arrangement 14A may comprise an electromagnetic valve 142A mounted on the steam inlet 113A, and a plurality of pressure sensors 143A provided in the internal tube member 1152A and the steam input tube 118A respectively for measuring the pressure in the internal tube member 1152A and the steam input tube 118A respectively. The operation of the safety arrangement 14A is the same as that mentioned in the preferred embodiment and the first alternative mode above.

Figure 12:
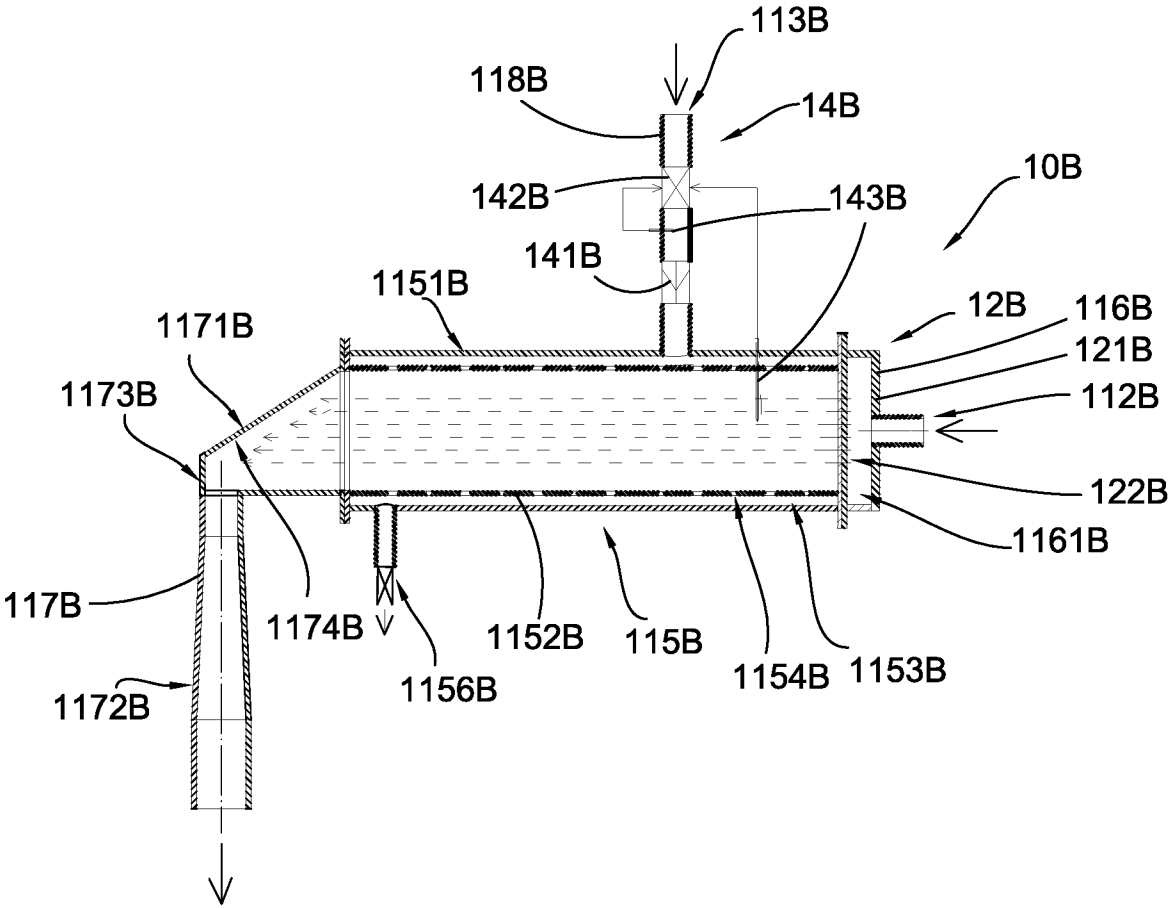
FIG. 12 a schematic diagram of a fourth alternative mode of the injection feedwater heater according to the first preferred embodiment of the present invention.
Figure 13:
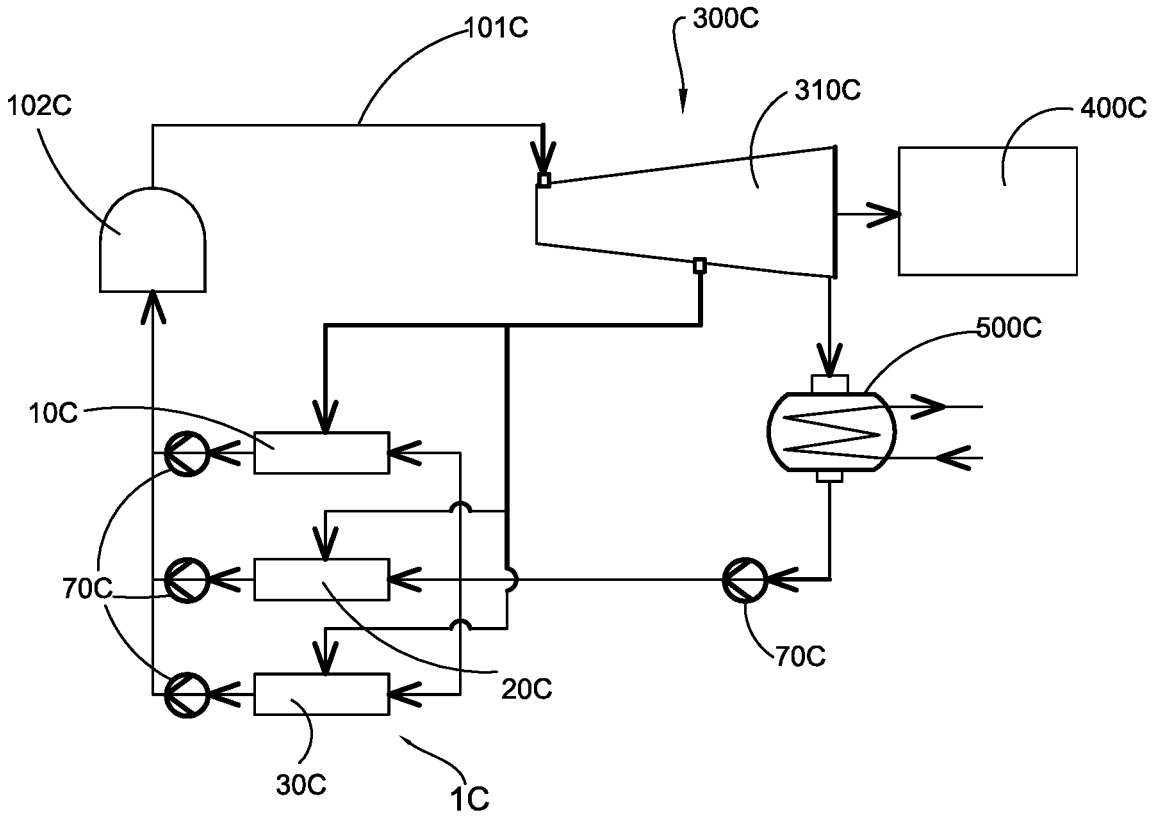
FIG. 13 is a schematic diagram of a steam power generating system according to a second preferred embodiment of the present invention.

Referring to FIG. 12 of the drawings, a fourth alternative mode of the injection feedwater heater 10B according to the first preferred embodiment of the present invention is illustrated. The fourth alternative mode is structurally identical to the injection feedwater heater 10' described in the third alternative mode, except the water discharging tube 117B.

According to the fourth alternative mode, the water discharging tube 117B may have a guiding portion 1171B, a pressurizing portion 1172B, and a buffering portion 1173B extended between the guiding portion 1171B and the pressurizing portion 1172B. The guiding portion 1171B may extend from the heat exchanging tube 115B and may have a diameter gradually decreasing from the heat exchanging tube 115B. In this fourth alternative mode, the guiding portion 1171B may also have an inclined guiding surface 1174B wherein the water coming from the heat exchanging tube 115B may be arranged to hit the inclined guiding surface 1174B and be guided to flow to the buffering portion 1173B.

In this fourth alternative mode, the guiding portion 1171B may extend from the internal tube member 1152B along a longitudinal direction thereof, while the buffering portion 1173B and the pressurizing portion 1172B may extend from the guiding portion 1171B along a transverse direction thereof. In other words, a longitudinal axis of the buffering portion 1173B and the pressurizing portion 1172B may form an approximately 90° of inclination with respect to a longitudinal axis of the guiding portion 1171B. This configuration is graphically depicted in FIG. 12 of the drawings.

On the other hand, the water release port 1156B may be formed on the external tube member 1151B for allowing residual water to be discharged out of the receiving gap 1153B, which is formed between the external tube member 1151B and the internal tube member 1152B. The holes 1154B may be formed on the internal tube member 1152B. Moreover, the injection nozzle 12B may be provided between the water collection head 116B and the heat exchanging tube 115B. The injection nozzle 12B may comprise a nozzle base 121B and have a plurality of injection holes 122B formed on the nozzle base 121B. The water collection chamber 1161B may communicate with the water inlet 112B.

The safety arrangement 14B may comprise an electromagnetic valve 142B mounted on the steam inlet 113B, and a plurality of pressure sensors 143B provided in the internal tube member 1152B and the steam input tube 118B respectively for measuring the pressure in the internal tube member 1152B and the steam input tube 118B respectively. The operation of the safety arrangement 14B is the same as that mentioned in the preferred embodiment and the first alternative mode above.

Referring to FIG. 13, and FIG. 14A to FIG. 14C of the drawings, a steam power generating system according to a second preferred embodiment of the present invention is illustrated. The second preferred embodiment is similar to what has been disclosed in the first preferred embodiment except the configuration of the various components of the steam power generating system. According to the second preferred embodiment of the present invention, the feedwater preheat arrangement 1C may comprise first through third injection feedwater heater 10C, 20C, 30C connected in parallel by the connecting pipes 101C, wherein the first through third injection feedwater heater 10C, 20C, 30C may be connected to the turbine assembly 300C (comprising at least one turbine 310C) and the steam generator 102C. Each of the first through third injection feedwater heater 10C, 20C, 30C may be structurally identical, or may be a combination of the above-disclosed variation of the injection feedwater heater. The first through third injection feedwater heater 10C, 20C, 30C may be structurally identical to those disclosed in the first preferred embodiment above.

Thus, the first through third injection feedwater heater 10C, 20C, 30C may be connected to the condenser 500B and the turbine assembly 300C through at least one of the connecting pipes 101C. A total of four pumping devices 70C may be utilized in the second preferred embodiment. The turbine assembly 300C may be connected to an electric generator 400C.

Figure 14A:
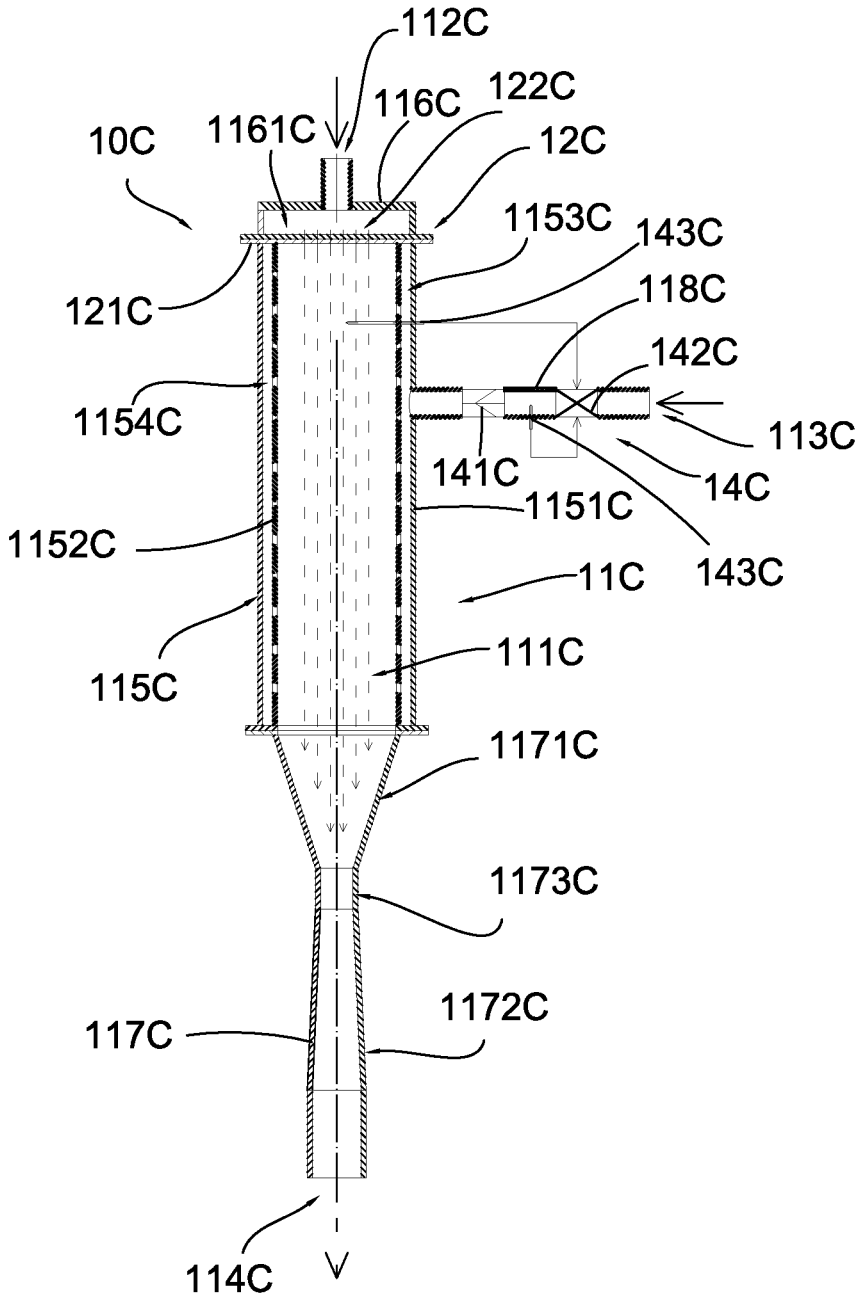
FIG. 14A to FIG. 14C are schematic diagrams of first through third injection feedwater heater according to a second preferred embodiment of the present invention respectively.

As shown in FIG. 14A of the drawings, the first injection feedwater heater 10C may comprise a first main heater body 11C and a first injection nozzle 12C. The first main heater body 11C may have a first heat exchange compartment 111C, a first water inlet 112C, a first steam inlet 113C, and a first water outlet 114C formed on the first main heater body 11C.

The first injection nozzle 12C may be provided in the first main heater body 11C at a position adjacent to the first water inlet 112C, wherein a predetermined amount of the condensate water from the condenser 500C may be arranged to be pumped into the first main heater body 11C through the first water inlet 112C. The condensate water passing through the first water inlet 112C may be arranged to be injected into the first heat exchange compartment 111C through the first injection nozzle 12C for creating a negative pressure in the first heat exchange compartment 111C. The negative pressure may then draw a predetermined amount of steam from the turbine assembly 300C to enter the first heat exchange compartment 111C through the steam inlet 113C for mixing with the condensate water. The condensate water may be heated up by the steam which is then condensed into water and arranged to be discharged out of the first heat exchange compartment 111C through the first water outlet 114C.

The first main heater body 11C may comprise a first heat exchanging tube 115C and a first water collection head 116C connected to the first heat exchanging tube 115C, wherein the first water inlet 112C may be formed on the first water collection head 116C while the first heat exchange compartment 111C may be formed in the first heat exchanging tube 115C.

The first main heater body 11C may further comprise a first water discharging tube 117C extended from the first heat exchanging tube 115C, wherein the first water outlet 114C may be formed on the first water discharging tube 117C. Condensate water coming from the condenser 500B may sequentially pass through the first water inlet 112C, the first water collection head 116C, the first heat exchanging tube 115C, the first water discharging tube 117C, and the first water outlet 114C.

The first water collection head 116C may have a first water collection chamber 1161C. The first water inlet 112C may be formed on the first water collection head 116C and may communicate with the first water collection chamber 1161C. The first heat exchanging tube 115C may comprise a first external tube member 1151C and a first internal tube member 1152C for forming a double wall structure of the first heat exchanging tube 115C. The first steam inlet 113C may be formed on the first external tube member 1151C of the first heat exchanging tube 115C. A diameter of the first internal tube member 1152C may be less than that of the first external tube member 1151C so as to form a first receiving gap 1153C between the first external tube member 1151C and the first internal tube member 1152C. The first heat exchange compartment 111C may be formed inside the first internal tube member 1152C.

The first internal tube member 1152C may have a plurality of first holes 1154C formed thereon for communicating the first receiving gap 1153C with the first heat exchange compartment 111C. Thus, steam from the turbine 310C may enter the first heat exchanging tube 115C through the first steam inlet 113C.

The first injection nozzle 12C may be provided between the first water collection head 116C and the first heat exchanging tube 115C. The first injection nozzle 12C comprise a first nozzle base 121C and have a plurality of first injection holes 122C formed on the first nozzle base 121C, wherein the first injection holes 122C may communicate the first water collection chamber 1161C with the first heat exchange compartment 111C so that water collected in the first water collection chamber 1161C may be injected into the first heat exchange compartment 111C through the first injection holes 122C.

The first water discharging tube 117C may have a first guiding portion 1171C, a first pressurizing portion 1172C, and a first buffering portion 1173C extended between the first guiding portion 1171C and the first pressurizing portion 1172C. The first guiding portion 1171C may extend from the first heat exchanging tube 115C and may have a diameter gradually decreasing from the first heat exchanging tube 115C so as to form a tapered cross-section shape for collecting and guiding water flow in the guiding portion.

The first pressurizing portion 1172C may extend from the first buffering portion 1173C and may have a diameter gradually increasing from the first buffering portion 1173C so that the water passing through the first pressurizing portion 1172C may have increasing pressure but decreasing flow rate.

The first injection feedwater heater 12C may further comprise a first safety arrangement 14C provided on the first heat exchanging tube 115C for preventing fluid, such as condensate water, from exiting the first heat exchanging tube 115C and reaching the turbine 310B through the first steam inlet 113C.

The first main heater body 11C may further comprise a first steam input tube 118C extending from the first external tube member 1151C, wherein the first steam inlet 113C may be formed in the first steam input tube 118C. The first safety arrangement 14C may comprise a first unidirectional valve 141C mounted in the first steam input tube 118C for preventing water from exiting the first heat exchanging tube 115C and reaching the turbine 310B through the first steam inlet 113C.

The first safety arrangement 14C may further comprise a first electromagnetic valve 142C mounted on the first steam inlet 113C, and a plurality of first pressure sensors 143C provided in the first internal tube member 1152C and the first steam input tube 118C respectively for measuring the pressure in the first internal tube member 1152C and the first steam input tube 118C respectively. The first pressure sensors 143C may be electrically connected to the first electromagnetic valve 142C so that when the first pressure sensors 143C detect that the pressure in the first steam input tube 118C is lower than that of the first heat exchange compartment 111C, the first electromagnetic valve 142C may be arranged to turn off the corresponding pumping device 70B for stopping condensate water from further feeding into the first injection feedwater heater 10C.

Figure 14B:
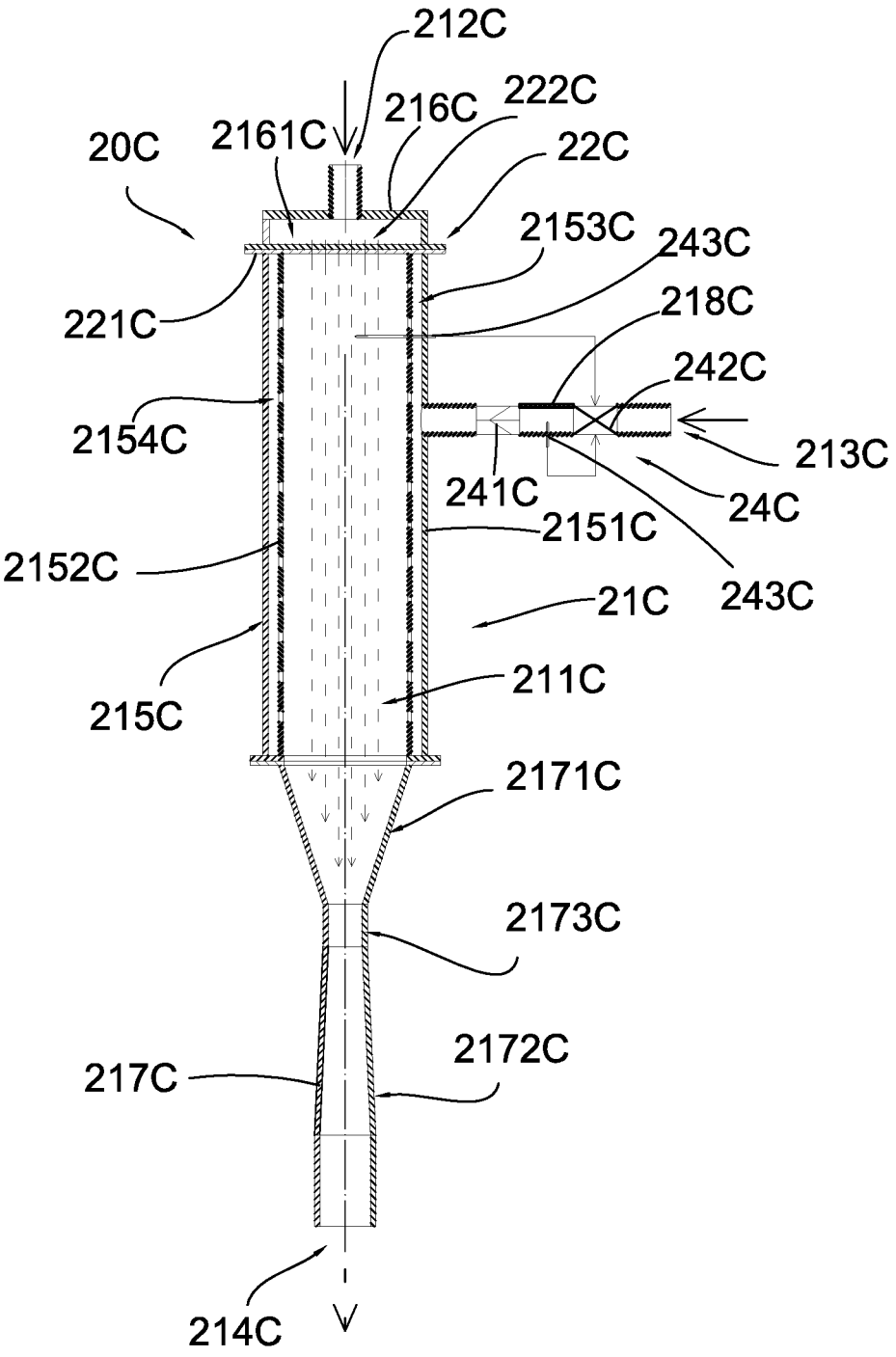

As shown in FIG. 14B of the drawings, the second injection feedwater heater 20C may comprise a second main heater body 21C and a second injection nozzle 22C. The second main heater body 21C may have a second heat exchange compartment 211C, a second water inlet 212C, a second steam inlet 213C, and a second water outlet 214C formed on the second main heater body 21C.

The second injection nozzle 22C may be provided in the second main heater body 21C at a position adjacent to the second water inlet 212C, wherein a predetermined amount of the condensate water from the condenser 500C may be arranged to be pumped into the second main heater body 21C through the second water inlet 212C.

The second main heater body 21C may comprise a second heat exchanging tube 215C and a second water collection head 216C connected to the second heat exchanging tube 215C, wherein the second water inlet 212C may be formed on the second water collection head 216C while the second heat exchange compartment 211C may be formed in the second heat exchanging tube 215C.

The second main heater body 21C may further comprise a second water discharging tube 217C extended from the second heat exchanging tube 215C, wherein the second water outlet 214C may be formed on the second water discharging tube 217C. Condensate water coming from the condenser 500C may sequentially pass through the second water inlet 212C, the second water collection head 216C, the second heat exchanging tube 215C, the second water discharging tube 217C, and the second water outlet 214C.

The second water collection head 216C may have a second water collection chamber 2161C. The second water inlet 212C may be formed on the second water collection head 216C and may communicate with the second water collection chamber 2161C. The second heat exchanging tube 215C may comprise a second external tube member 2151C and a second internal tube member 2152C for forming a double wall structure of the second heat exchanging tube 215C. The second steam inlet 213C may be formed on the second external tube member 2151C of the second heat exchanging tube 215C. A diameter of the second internal tube member 2152C may be less than that of the second external tube member 2151C so as to form a second receiving gap 2153C between the second external tube member 2151C and the second internal tube member 2152C. The second heat exchange compartment 211C may be formed inside the second internal tube member 2152C.

The second internal tube member 2152C may have a plurality of second holes 2154C formed thereon for communicating the second receiving gap 2153C with the second heat exchange compartment 211C. Thus, steam from the turbine 310C may enter the second heat exchanging tube 215C through the second steam inlet 213C.

The second injection nozzle 22C may be provided between the second water collection head 216C and the second heat exchanging tube 215C. The second injection nozzle 22C comprise a second nozzle base 221C and have a plurality of second injection holes 222C formed on the second nozzle base 221C, wherein the second injection holes 222C may communicate the second water collection chamber 2161C with the second heat exchange compartment 211C so that water collected in the second water collection chamber 2161C may be injected into the second heat exchange compartment 211C through the second injection holes 222C.

The second water discharging tube 217C may have a second guiding portion 2171C, a second pressurizing portion 2172C, and a second buffering portion 2173C extended between the second guiding portion 2171C and the second pressurizing portion 2172C. The second guiding portion 2171C may extend from the second heat exchanging tube 215C and may have a diameter gradually decreasing from the second heat exchanging tube 215C so as to form a tapered cross-section shape for collecting and guiding water flow in the guiding portion.

The second pressurizing portion 2172C may extend from the second buffering portion 2173C and may have a diameter gradually increasing from the second buffering portion 2173C so that the water passing through the second pressurizing portion 2172C may have increasing pressure but decreasing flow rate.

The second injection feedwater heater 22C may further comprise a second safety arrangement 24C provided on the second heat exchanging tube 215C for preventing fluid, such as condensate water, from exiting the second heat exchanging tube 215C and reaching the turbine 310C through the second steam inlet 213C.

The second main heater body 21C may further comprise a second steam input tube 218C extending from the second external tube member 2151C, wherein the second steam inlet 213C may be formed in the second steam input tube 218C. The second safety arrangement 24C may comprise a second unidirectional valve 241C mounted in the second steam input tube 218C for preventing water from exiting the second heat exchanging tube 215C and reaching the turbine 310C through the second steam inlet 213C.

The second safety arrangement 24C may further comprise a second electromagnetic valve 242C mounted on the second steam inlet 213C, and a plurality of second pressure sensors 243C provided in the second internal tube member 2152C and the second steam input tube 218C respectively for measuring the pressure in the second internal tube member 2152C and the second steam input tube 218C respectively. The second pressure sensors 243C may be electrically connected to the second electromagnetic valve 242C so that when the second pressure sensors 243C detect that the pressure in the second steam input tube 218C is lower than that of the second heat exchange compartment 211C, the second electromagnetic valve 242C may be arranged to turn off the corresponding pumping device 70C.

Figure 14C:
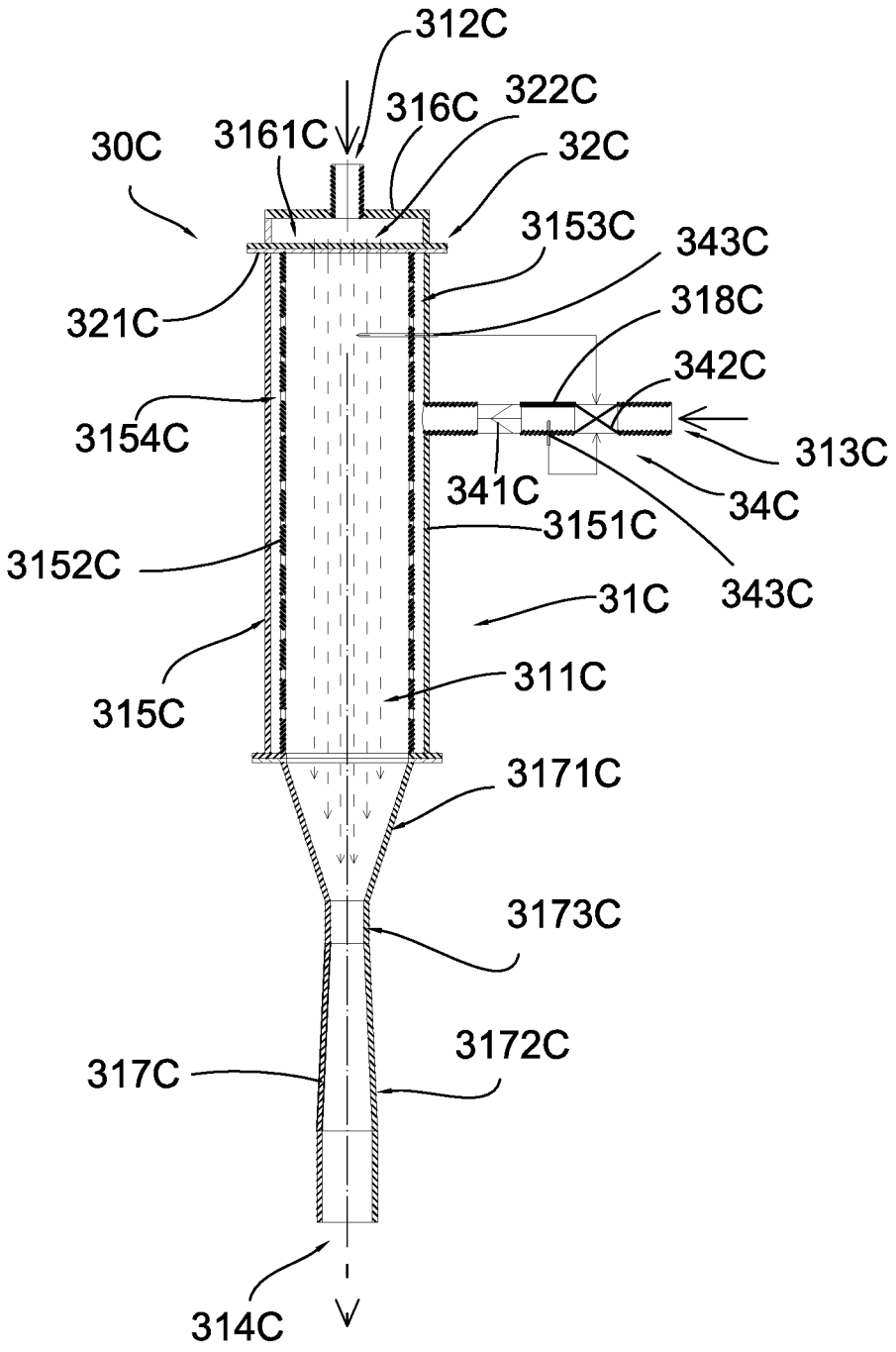

As shown in FIG. 14C of the drawings, the third injection feedwater heater 30C may comprise a third main heater body 31C and a third injection nozzle 32C. The third main heater body 31C may have a third heat exchange compartment 311C, a third water inlet 312C, a third steam inlet 313C, and a third water outlet 314C formed on the third main heater body 31C.

The third injection nozzle 32C may be provided in the third main heater body 31C at a position adjacent to the third water inlet 312C, wherein a predetermined amount of the condensate water from the condenser 500C may be arranged to be pumped into the third main heater body 31C through the third water inlet 312C. The condensate water passing through the third water inlet 312C may be arranged to be injected into the third heat exchange compartment 311C through the third injection nozzle 32C for creating a negative pressure in the third heat exchange compartment 311B. The negative pressure may then draw a predetermined amount of steam from the turbine assembly 300C to enter the third heat exchange compartment 311C through the steam inlet 313C for mixing with the condensate water. The condensate water may be heated up by the steam which is then condensed into water and arranged to be discharged out of the third heat exchange compartment 311C through the third water outlet 314C.

The third main heater body 31C may comprise a third heat exchanging tube 315C and a third water collection head 316C connected to the third heat exchanging tube 315B, wherein the third water inlet 312C may be formed on the third water collection head 316C while the third heat exchange compartment 311C may be formed in the third heat exchanging tube 315B.

The third main heater body 31C may further comprise a third water discharging tube 317C extended from the third heat exchanging tube 315C, wherein the third water outlet 314C may be formed on the third water discharging tube 317C.

The third water collection head 316C may have a third water collection chamber 3161C. The third water inlet 312C may be formed on the third water collection head 316C and may communicate with the third water collection chamber 3161C. The third heat exchanging tube 315C may comprise a third external tube member 3151C and a third internal tube member 3152C for forming a double wall structure of the third heat exchanging tube 315C. The third steam inlet 313C may be formed on the third external tube member 3151C of the third heat exchanging tube 315C. A third receiving gap 3153C may be formed between the third external tube member 3151C and the third internal tube member 3152C. The third heat exchange compartment 311C may be formed inside the third internal tube member 3152C.

The third internal tube member 3152C may have a plurality of third holes 3154C formed thereon for communicating the third receiving gap 3153C with the third heat exchange compartment 311C. Thus, steam from the turbine 310C may enter the third heat exchanging tube 315C through the third steam inlet 313C.

Again, the third injection nozzle 32C may be provided between the third water collection head 316C and the third heat exchanging tube 315C. The third injection nozzle 32C comprise a third nozzle base 321C and have a plurality of third injection holes 322C formed on the third nozzle base 321C.

The third water discharging tube 317C may have a third guiding portion 3171C, a third pressurizing portion 3172C, and a third buffering portion 3173C extended between the third guiding portion 3171C and the third pressurizing portion 3172C. The third guiding portion 3171C may extend from the third heat exchanging tube 315C and may have a diameter gradually decreasing from the third heat exchanging tube 315C so as to form a tapered cross-section shape for collecting and guiding water flow in the guiding portion. The third pressurizing portion 3172C may extend from the third buffering portion 3173C and may have a diameter gradually increasing from the third buffering portion 3173C so that the water passing through the third pressurizing portion 3172C may have increasing pressure but decreasing flow rate.

The third injection feedwater heater 32C may further comprise a third safety arrangement 34C provided on the third heat exchanging tube 315C for preventing fluid, such as condensate water, from exiting the third heat exchanging tube 315C and reaching the turbine 310C through the third steam inlet 313C.

The third main heater body 31C may further comprise a third steam input tube 318C extending from the third external tube member 3151C, wherein the third steam inlet 313C is formed in the third steam input tube 318B. The third safety arrangement 34C may comprise a third unidirectional valve 341C mounted in the third steam input tube 318C for preventing water from exiting the third heat exchanging tube 315C and reaching the turbine 310C through the third steam inlet 313C.

Moreover, the third safety arrangement 34C may further comprise a third electromagnetic valve 342C mounted on the third steam inlet 313C, and a plurality of third pressure sensors 343C provided in the third internal tube member 3152C and the third steam input tube 318C respectively for measuring the pressure in the third internal tube member 3152C and the third steam input tube 318C respectively. The third pressure sensors 343C may be electrically connected to the third electromagnetic valve 342C so that when the third pressure sensors 343C detect that the pressure in the third steam input tube 318C is lower than that of the third heat exchange compartment 311C, the third electromagnetic valve 342C may be arranged to turn off the corresponding pumping device 70C for stopping condensate water from further feeding into the third injection feedwater heater 30C.

Referring back to FIG. 13 of the drawings, the first through third injection feedwater heaters 10C, 20C, 30C are connected in parallel so that condensate water from the condenser 500C may be guided to flow into the first through third injection feedwater heaters 10C, 20C, 30C simultaneously while at the same time, the steam from the turbine assembly 300C may also be fed into the first through third injection feedwater heaters 10C, 20C, 30C through the first through third steam inlets 113C, 213C, 313C.

Each of the first water outlet 114C, second water outlet 214C and the third water outlet 314C may be connected to a pumping device 70C. The water from the first through third water outlet 114C, 214C, 314C may be collected and guided to flow back to the steam generator 102C. Note that the first through third injection feedwater heater 10C, 20C, 30C may be structurally identical, or may take the form of any of the variations or alternatives described above. Thus, the first through third injection feedwater heater 10C, 20C, 30C may be placed vertically, horizontally, or a combination thereof.

Referring to FIG. 145 of the drawings, a steam power generating system according to a third preferred embodiment of the present invention is illustrated. The third preferred embodiment is similar to the second preferred embodiment described above, except the configuration various components of the feedwater preheat arrangement 1D.

According to the third preferred embodiment of the present invention, the steam power generating system may also comprise a steam generator 102D, a turbine assembly 300D comprising at least one turbine 310D, an electric generator 400D electrically connected to the turbine assembly 300D, a condenser 500D connected to the turbine assembly 300D, and the feedwater preheat arrangement 1D. The feedwater preheat arrangement 1D may comprise first through third injection feedwater heater 10C, 20C, 30C. Two pumping devices 70D may be used in the third preferred embodiment. The various components may also be connected by a plurality of connecting pipes 101D. These components are structurally identical to those described in the first and the second preferred embodiment above.

Referring to FIG. 145 of the drawings, the steam generator 102D may be connected to the turbine assembly 300D so that superheated steam may be used to turn at least one turbine 310D. The mechanical energy may be converted into electrical energy through the electric generator 400D The turbine assembly 300D may be connected to the condenser 500D for condensing the steam coming from the turbine assembly 300D. At the same time, the turbine assembly 300D may also be connected to each of the first through third injection feedwater heater 10C, 20C, 30C so that steam may be arranged to enter the respective heat exchange compartment 111C (211C) (311C). The condenser 500D may be connected to a pumping device 70D which may then be connected to the first injection feedwater heater 10C.

The steam power generating system may further comprise a deaerator 100D connected to the first injection feedwater heater 10C so that the condensate water coming out from the first injection feedwater heater 10C may be arranged to enter the deaerator 100D. The deaerator 100D may be utilized to remove a certain amount of oxygen from the condensate water coming out from the first injection feedwater heater 10C. The deaerator 100D may also be connected to the turbine assembly 300D so that steam may also be arranged to enter the deaerator 100D.

The deaerator 100D may be connected to another pumping device 70D which may be connected to the second injection feedwater heater 20C. The second injection feedwater heater 20C may be connected to the third injection feedwater heater 30C in series. Finally, the third injection feedwater heater 30C may be connected to the steam generator 102D.

Thus, the water from the deaerator 100D may be guided to flow into the second injection feedwater heater 20C for further heating. The water coming out from the second injection feedwater heater 20C may be guided to flow into the third injection feedwater heater 30C for further heating. After that, the water coming out from the third injection feedwater heater 30C may be guided to flow back to the steam generator 102D for being converted back to superheated steam to perform another cycle of electricity generation.

In the third preferred embodiment, each of the first through third injection feedwater heater 10C, 20C, 30C may be configured to have an identical structure as that described in the second preferred embodiment or the various alternative modes above, or a combination thereof.

Figure 15:
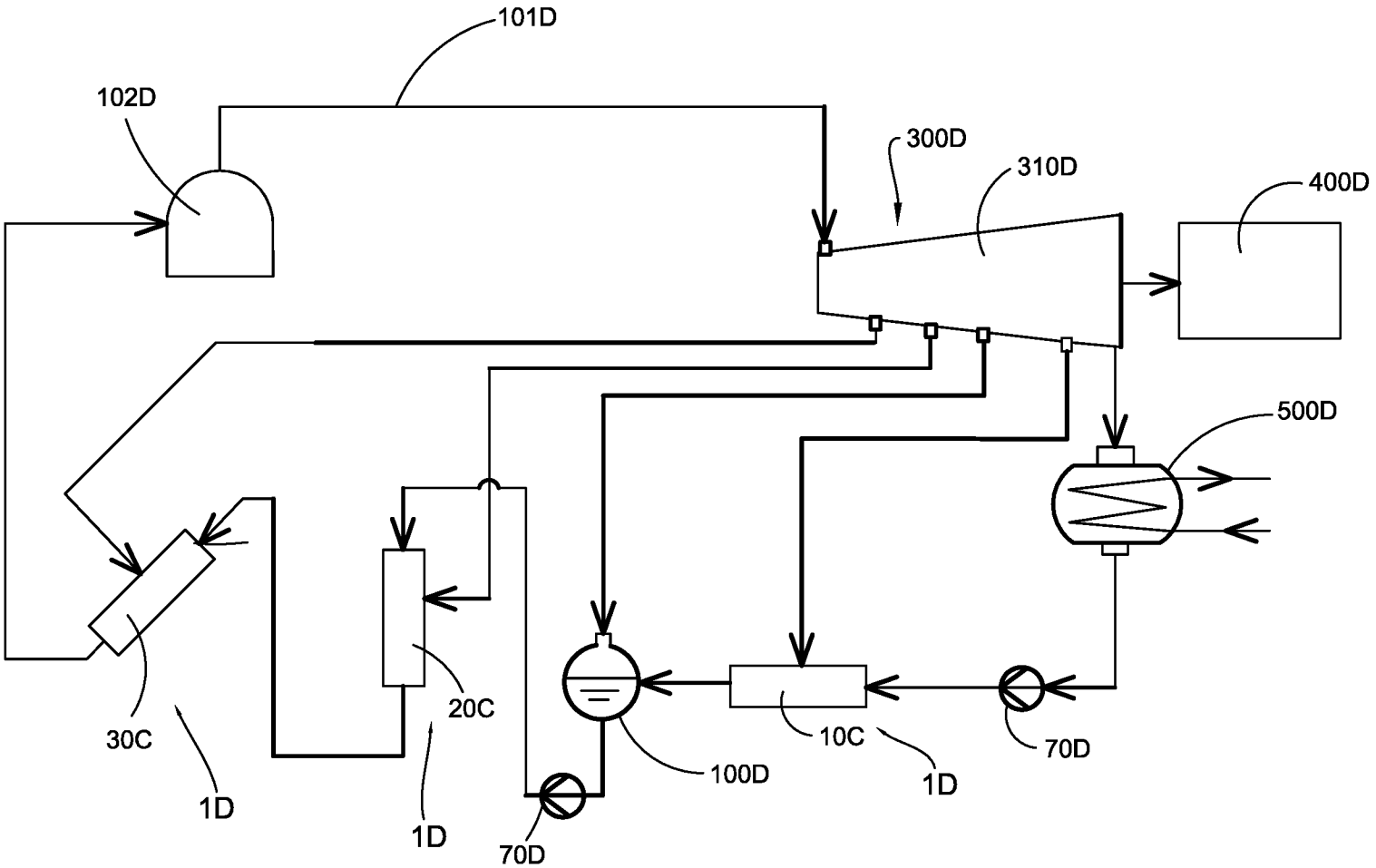
FIG. 15 is a schematic diagram of a steam power generating system according to a third preferred embodiment of the present invention.
Figure 16:
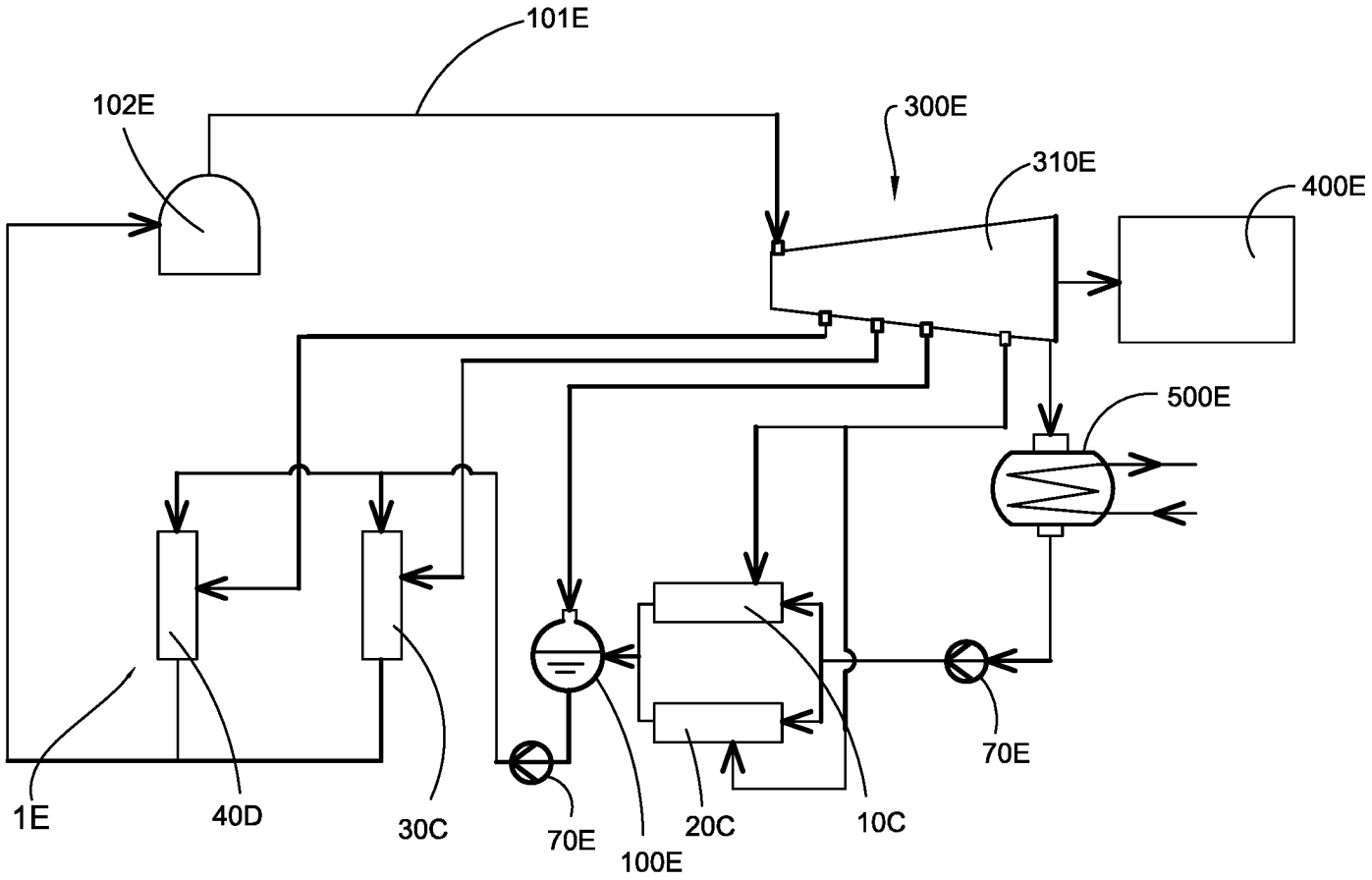
FIG. 16 is a schematic diagram of a steam power generating system according to a fourth preferred embodiment of the present invention.

Referring to FIG. 15 to FIG. 16 of the drawings, a steam power generating system according to a fourth preferred embodiment of the present invention is illustrated. The fourth preferred embodiment is similar to the third preferred embodiment described above, except the configuration various components of the steam power generating system. Moreover, the feedwater preheat arrangement 1E may further comprise a fourth injection feedwater heater 40D. The fourth injection feedwater heater 40D may have identical structure as that of the first through third injection feedwater heater 10C, 20C, 30C described above.

As shown in FIG. 16 of the drawings, the fourth injection feedwater heater 40D may comprise a fourth main heater body 41D and a fourth injection nozzle 42D. The fourth main heater body 41D may have a fourth heat exchange compartment 411D, a fourth water inlet 412C, a fourth steam inlet 413D, and a fourth water outlet 414D formed on the fourth main heater body 41D.

The fourth injection nozzle 42D may be provided in the fourth main heater body 41D at a position adjacent to the fourth water inlet 412D, wherein a predetermined amount of the condensate water from the condenser 500E may be arranged to be pumped into the fourth main heater body 41D through the fourth water inlet 412D. The condensate water passing through the fourth water inlet 412D may be arranged to be injected into the fourth heat exchange compartment 411D through the fourth injection nozzle 42D for creating a negative pressure in the fourth heat exchange compartment 411D. The negative pressure may then draw a predetermined amount of steam from the turbine assembly 300E (comprising at least one turbine 310E) to enter the fourth heat exchange compartment 411D through the steam inlet 413D for mixing with the condensate water. The condensate water may be heated up by the steam which is then condensed into water and arranged to be discharged out of the fourth heat exchange compartment 411D through the fourth water outlet 414D.

The fourth main heater body 41D may comprise a fourth heat exchanging tube 415D and a fourth water collection head 416D connected to the fourth heat exchanging tube 415D, wherein the fourth water inlet 412D may be formed on the fourth water collection head 416D while the fourth heat exchange compartment 411D may be formed in the fourth heat exchanging tube 415D.

The fourth main heater body 11C may further comprise a fourth water discharging tube 417D extended from the fourth heat exchanging tube 415D, wherein the fourth water outlet 414D may be formed on the fourth water discharging tube 417D.

The fourth water discharging tube 417D may have a fourth guiding portion 4171D, a fourth pressurizing portion 4172D, and a fourth buffering portion 4173D extended between the fourth guiding portion 4171D and the fourth pressurizing portion 4172D. The fourth guiding portion 4171D may extend from the fourth heat exchanging tube 415D and may have a diameter gradually decreasing from the fourth heat exchanging tube 415D so as to form a tapered cross-section shape for collecting and guiding water flow in the guiding portion.

The fourth pressurizing portion 4172D may extend from the fourth buffering portion 4173D and may have a diameter gradually increasing from the fourth buffering portion 4173D so that the water passing through the fourth pressurizing portion 4172D may have increasing pressure but decreasing flow rate.

The fourth water collection head 416D may have a fourth water collection chamber 4161D. The fourth water inlet 412D may be formed on the fourth water collection head 416D and may communicate with the fourth water collection chamber 4161D. The fourth heat exchanging tube 415D may comprise a fourth external tube member 4151D and a fourth internal tube member 4152D for forming a double wall structure of the fourth heat exchanging tube 415D. The fourth steam inlet 413D may be formed on the fourth external tube member 4151D of the fourth heat exchanging tube 415D. A fourth receiving gap 4153D may be formed between the fourth external tube member 4151D and the fourth internal tube member 4152D. The fourth heat exchange compartment 411D may be formed inside the fourth internal tube member 4152D. The fourth internal tube member 4152D may have a plurality of fourth holes 4154D formed thereon for communicating the fourth receiving gap 4153D with the fourth heat exchange compartment 411D.

The fourth injection nozzle 42D may be provided between the fourth water collection head 416D and the fourth heat exchanging tube 415D. The fourth injection nozzle 42D comprise a fourth nozzle base 421D and have a plurality of fourth injection holes 422D formed on the fourth nozzle base 421D, wherein the fourth injection holes 422D may communicate the fourth water collection chamber 4161D with the fourth heat exchange compartment 411D so that water collected in the fourth water collection chamber 4161D may be injected into the fourth heat exchange compartment 411D through the fourth injection holes 422D.

The fourth injection feedwater heater 42D may further comprise a fourth safety arrangement 44D provided on the fourth heat exchanging tube 415D for preventing fluid, such as condensate water, from exiting the fourth heat exchanging tube 415D and reaching the turbine 310E through the fourth steam inlet 413D.

The fourth main heater body 41D may further comprise a fourth steam input tube 418D extending from the fourth external tube member 4151D, wherein the fourth steam inlet 413D is formed in the fourth steam input tube 418D. The fourth safety arrangement 44D may comprise a fourth unidirectional valve 441D mounted in the fourth steam input tube 418D for preventing water from exiting the fourth heat exchanging tube 415D and reaching the turbine 310E through the fourth steam inlet 413D.

The fourth safety arrangement 44D may further comprise a fourth electromagnetic valve 442D mounted on the fourth steam inlet 413D, and a plurality of fourth pressure sensors 443D provided in the fourth internal tube member 4152D and the fourth steam input tube 418D respectively for measuring the pressure in the fourth internal tube member 4152D and the fourth steam input tube 418D respectively. The fourth pressure sensors 443D may be electrically connected to the fourth electromagnetic valve 442D so that when the fourth pressure sensors 443D detect that the pressure in the fourth steam input tube 418D is lower than that of the fourth heat exchange compartment 411D, the fourth electromagnetic valve 442D may be arranged to turn off the corresponding pumping device 70E.

In this fourth preferred embodiment, the first injection feedwater heater 10C and the second injection feedwater heater 20C may be connected in parallel with each other, while the third injection feedwater heater 30C and the fourth injection feedwater heater 40D may be connected in parallel with each other.

As shown in FIG. 15 of the drawings, superheated steam may be generated in the steam generator 102E. The superheated steam may be guided to flow into the turbine assembly 300E comprising at least one turbine 310E. The turbine assembly 300E may also be connected to an electric generator 400E and a condenser 500E. The steam from the turbine assembly 300E may be guided to flow through the condenser 500E which may condense the steam into condensate water. The condenser 500E may be connected to a pumping device 70E and the first injection feedwater heater 10C and the second injection feedwater heater 20C. Note that the first injection feedwater heater 10C and the second injection feedwater heater 20C may be connected in parallel with respect to each other, while the first injection feedwater heater 10C and the second injection feedwater heater 20C may be connected in series with the condenser 500E and the pumping device 70E. This configuration is graphically depicted in FIG. 15 of the drawings.

Thus, the condensate water from the condenser 500E may be pumped to the first injection feedwater heater 10C and the second injection feedwater heater 20C at the same time through the first water inlet 112C and the second water inlet 212C respectively. Steam from the turbine assembly 300E may be fed into the first injection feedwater heater 10C and the second injection feedwater heater 20C through the first steam inlet 113C and the second steam inlet 213C respectively to perform heat exchange with the condensate water. After that, the condensate water may exit the first injection feedwater heater 10C and the second injection feedwater heater 20C through the first water outlet 114C and the second water outlet 214C.

The first injection feedwater heater 10C and the second injection feedwater heater 20C may also be connected to the deaerator 100E which may also be connected to the turbine assembly 300E. The deaerator 100E may further be connected to the third injection feedwater heater 30C and the fourth injection feedwater heater 40D. The third injection feedwater heater 30C and the fourth injection feedwater heater 40D may be connected in parallel with respect to each other. But the third injection feedwater heater 30C and the fourth injection feedwater heater 40D together may be connected to the deaerator 100E and the corresponding pumping device 70E in series. This configuration may be graphically depicted in FIG. 15 of the drawings.

The water from the deaerator 100E may be guided to flow into the third injection feedwater heater 30C and the fourth injection feedwater heater 40D through the third water inlet 312C and the fourth water inlet 412D. The third injection feedwater heater 30C and the fourth injection feedwater heater 40D may also be connected to the turbine assembly 300E so that steam may flow into the third heat exchange compartment 311C and the fourth heat exchange compartment 411D through the third steam inlet 313C and the fourth steam inlet 413D respectively. The water may then go out of the third injection feedwater heater 30C and the fourth injection feedwater heater 40D through the third water outlet 314C and the fourth water outlet 414D and may be guided to flow back to the steam generator 102E for performing another cycle of power generator.

In the fourth preferred embodiment of the present invention, the condensate water may undergo two stages of pre-heating process, one of which in the first injection feedwater heater 10C and the second injection feedwater heater 20C, while the other in the third injection feedwater heater 30C and the fourth injection feedwater heater 40D.

Figure 18:
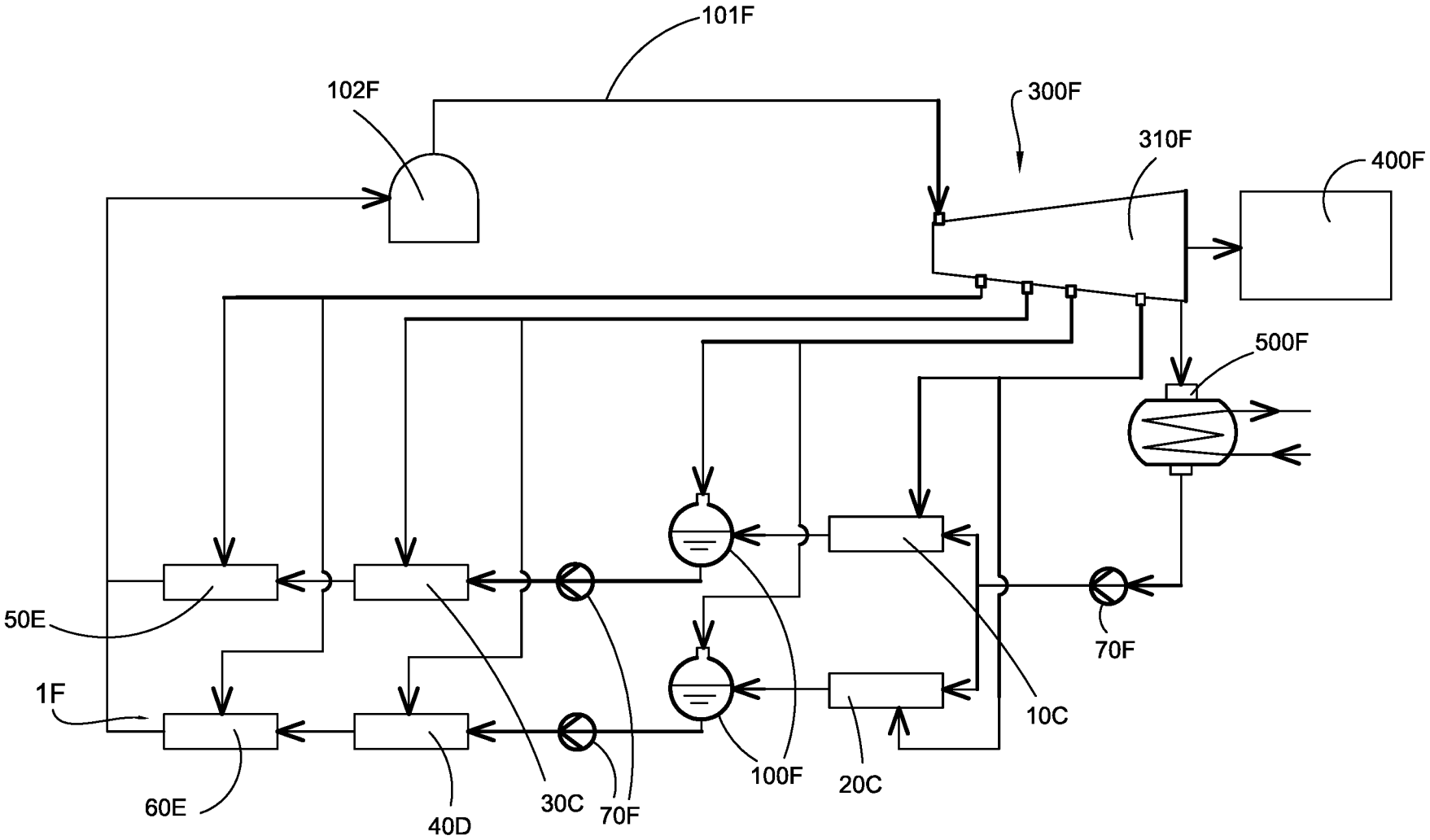
FIG. 18 is a schematic diagram of a steam power generating system according to a fifth preferred embodiment of the present invention.
Figure 19A:
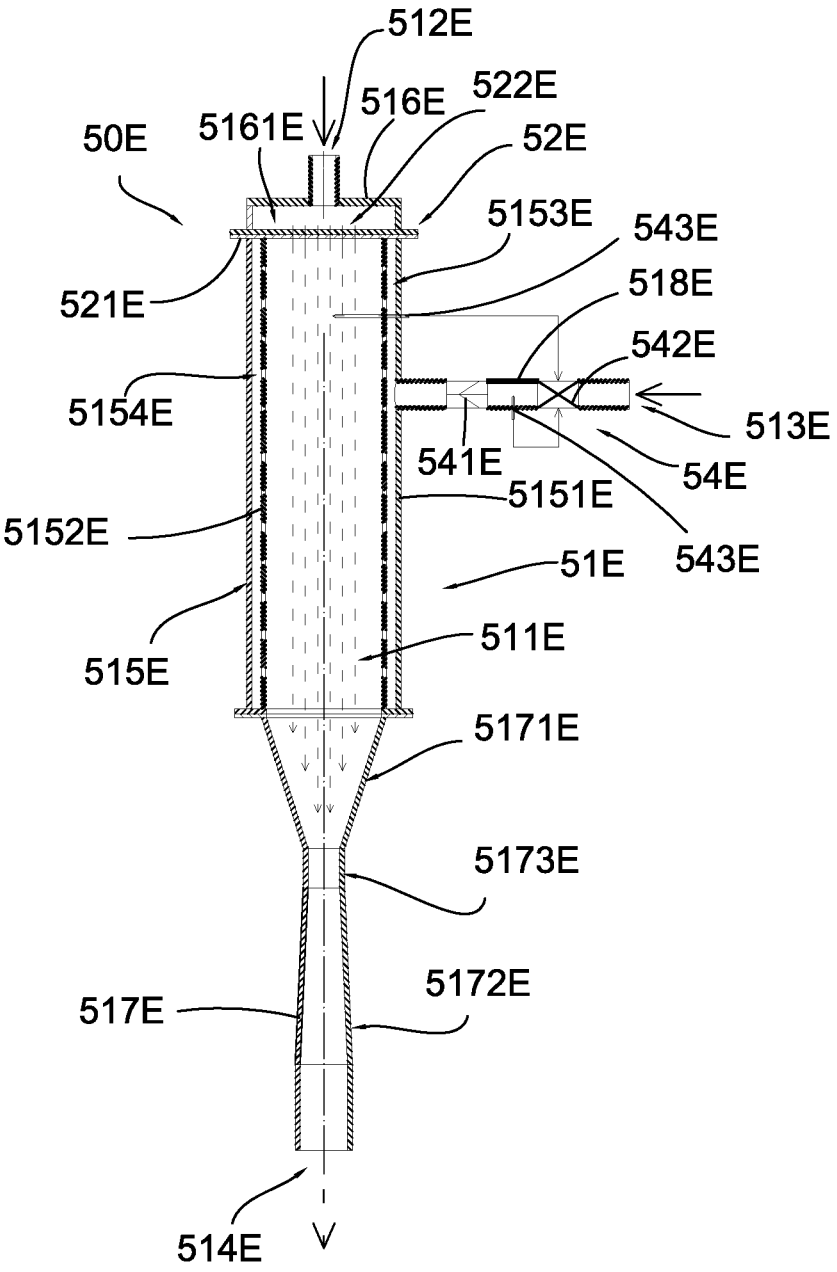
FIG. 19A to FIG. 19B are schematic diagrams of fifth through sixth injection feedwater heater according to a fifth preferred embodiment of the present invention respectively.
Figure 19B:
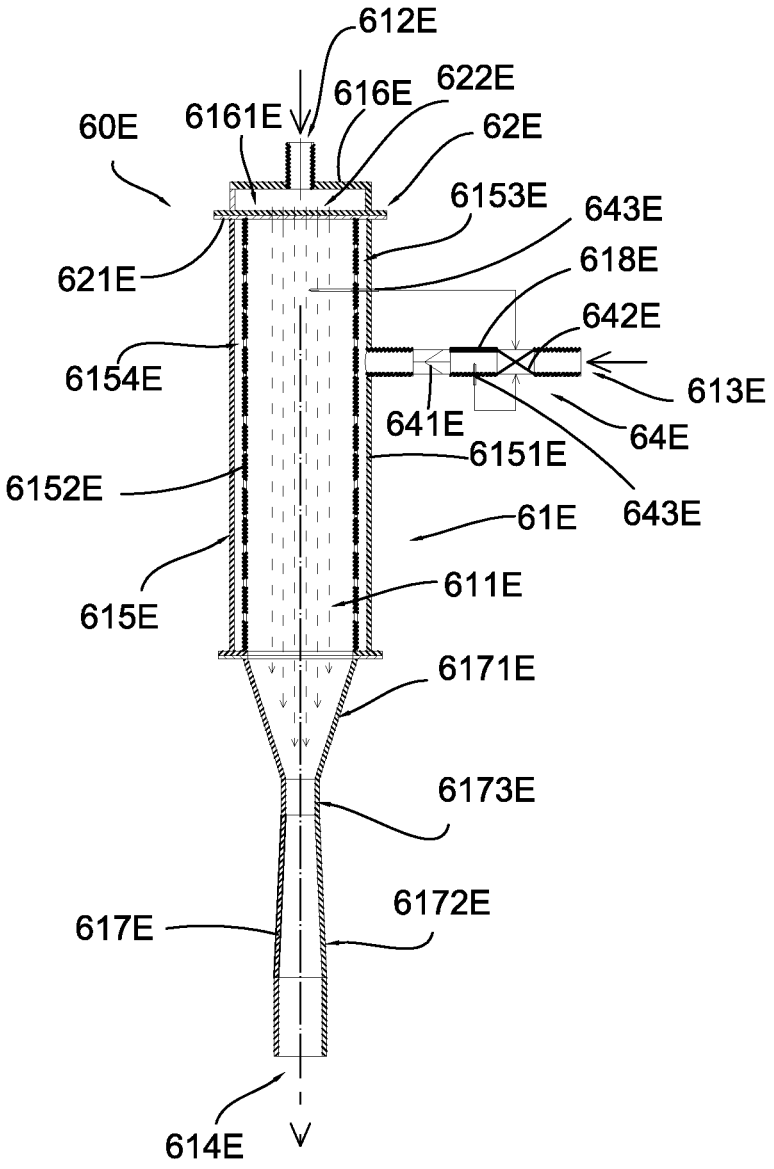

Referring to FIG. 18 and FIG. 19A and FIG. 19B of the drawings, a steam power generating system according to a fifth preferred embodiment of the present invention is illustrated. The fifth preferred embodiment is similar to the fourth preferred embodiment described above, except the configuration of the various components of the steam power generating system. Moreover, the feedwater preheat arrangement 1F may further comprise a fifth injection feedwater heater 50E and a sixth injection feedwater heater 60E. The fifth injection feedwater heater 50E and the sixth injection feedwater heater 60E may have identical structure as that of the first through fourth injection feedwater heater 10C, 20C, 30C, 40D described above.

As shown in FIG. 19A of the drawings, the fifth injection feedwater heater 50E may comprise a fifth main heater body 51E and a fifth injection nozzle 52E. The fifth main heater body 51E may have a fifth heat exchange compartment 511E, a fifth water inlet 512E, a fifth steam inlet 513E, and a fifth water outlet 514E formed on the fifth main heater body 51E.

The fifth injection nozzle 52E may be provided in the fifth main heater body 51E at a position adjacent to the fifth water inlet 512E, wherein a predetermined amount of the condensate water from the condenser 500F may be arranged to be pumped into the fifth main heater body 51E through the fifth water inlet 512E. The condensate water passing through the fifth water inlet 512E may be arranged to be injected into the fifth heat exchange compartment 511E through the fifth injection nozzle 52E for creating a negative pressure in the fifth heat exchange compartment 511E. The negative pressure may then draw a predetermined amount of steam from the turbine assembly 300F to enter the fifth heat exchange compartment 511E through the steam inlet 513E for mixing with the condensate water. The condensate water may be heated up by the steam which is then condensed into water and arranged to be discharged out of the fifth heat exchange compartment 511E through the fifth water outlet 514E.

The fifth main heater body 51E may comprise a fifth heat exchanging tube 515E and a fifth water collection head 516E connected to the fifth heat exchanging tube 515E, wherein the fifth water inlet 512E may be formed on the fifth water collection head 516E while the fifth heat exchange compartment 511E may be formed in the fifth heat exchanging tube 515E.

The fifth main heater body 51E may further comprise a fifth water discharging tube 517E extended from the fifth heat exchanging tube 515E, wherein the fifth water outlet 514E may be formed on the fifth water discharging tube 517E. Condensate water coming from the condenser 500F may sequentially pass through the fifth water inlet 512E, the fifth water collection head 516E, the fifth heat exchanging tube 515E, the fifth water discharging tube 517E, and the fifth water outlet 514E.

The fifth water collection head 516E may have a fifth water collection chamber 5161E. The fifth water inlet 512E may be formed on the fifth water collection head 516E and may communicate with the fifth water collection chamber 5161E. The fifth heat exchanging tube 515E may comprise a fifth external tube member 5151E and a fifth internal tube member 5152E for forming a double wall structure of the fifth heat exchanging tube 515E. The fifth steam inlet 513E may be formed on the fifth external tube member 5151E of the fifth heat exchanging tube 515E. A fifth receiving gap 5153E may be formed between the fifth external tube member 5151E and the fifth internal tube member 5152E. The fifth heat exchange compartment 511E may be formed inside the fifth internal tube member 5152E.

The fifth internal tube member 5152E may have a plurality of fifth holes 5154E formed thereon for communicating the fifth receiving gap 5153E with the fifth heat exchange compartment 511E. Thus, steam from the turbine 310F may enter the fifth heat exchanging tube 515E through the fifth steam inlet 513E.

The fifth injection nozzle 52E may be provided between the fifth water collection head 516E and the fifth heat exchanging tube 515E. The fifth injection nozzle 52E comprise a fifth nozzle base 521E and have a plurality of fifth injection holes 522E formed on the fifth nozzle base 521E, wherein the fifth injection holes 522E may communicate the fifth water collection chamber 5161E with the fifth heat exchange compartment 511E so that water collected in the fifth water collection chamber 5161E may be injected into the fifth heat exchange compartment 511E through the fifth injection holes 522E.

The fifth water discharging tube 517E may have a fifth guiding portion 5171E, a fifth pressurizing portion 5172E, and a fifth buffering portion 5173E extended between the fifth guiding portion 5171E and the fifth pressurizing portion 5172E. The fifth guiding portion 5171E may extend from the fifth heat exchanging tube 515E and may have a diameter gradually decreasing from the fifth heat exchanging tube 515E so as to form a tapered cross-section shape for collecting and guiding water flow in the fifth guiding portion 5171E.

The fifth pressurizing portion 5172E may extend from the fifth buffering portion 5173E and may have a diameter gradually increasing from the fifth buffering portion 5173E so that the water passing through the fifth pressurizing portion 5172E may have increasing pressure but decreasing flow rate.

The fifth injection feedwater heater 52E may further comprise a fifth safety arrangement 54E provided on the fifth heat exchanging tube 515E for preventing fluid, such as condensate water, from exiting the fifth heat exchanging tube 515E and reaching the turbine 310E through the fifth steam inlet 513E.

The fifth main heater body 51E may further comprise a fifth steam input tube 518E extending from the fifth external tube member 5151E, wherein the fifth steam inlet 513E is formed in the fifth steam input tube 518E. The fifth safety arrangement 54E may comprise a fifth unidirectional valve 541E mounted in the fifth steam input tube 518E for preventing water from exiting the fifth heat exchanging tube 515E and reaching the turbine 310F through the fifth steam inlet 513E.

The fifth safety arrangement 54E may further comprise a fifth electromagnetic valve 542E mounted on the fifth steam inlet 513E, and a plurality of fifth pressure sensors 543E provided in the fifth internal tube member 5152E and the fifth steam input tube 518E respectively for measuring the pressure in the fifth internal tube member 5152E and the fifth steam input tube 518E respectively. The fifth pressure sensors 543E may be electrically connected to the fifth electromagnetic valve 542E so that when the fifth pressure sensors 543E detect that the pressure in the fifth steam input tube 518E is lower than that of the fifth heat exchange compartment 511E, the fifth electromagnetic valve 542E may be arranged to turn off the corresponding pumping device 70F for stopping condensate water from further feeding into the fifth injection feedwater heater 50E.

As shown in FIG. 18B of the drawings, the sixth injection feedwater heater 60E may comprise a sixth main heater body 61E and a sixth injection nozzle 62E. The sixth main heater body 61E may have a sixth heat exchange compartment 611E, a sixth water inlet 612E, a sixth steam inlet 613E, and a sixth water outlet 614E formed on the sixth main heater body 61E.

The sixth injection nozzle 62E may be provided in the sixth main heater body 61E at a position adjacent to the sixth water inlet 612E, wherein a predetermined amount of the condensate water from the condenser 500F may be arranged to be pumped into the sixth main heater body 61E through the sixth water inlet 612E. The condensate water passing through the sixth water inlet 612E may be arranged to be injected into the sixth heat exchange compartment 611E through the sixth injection nozzle 62E for creating a negative pressure in the sixth heat exchange compartment 611E. The negative pressure may then draw a predetermined amount of steam from the turbine assembly 300F to enter the sixth heat exchange compartment 611E through the steam inlet 613E for mixing with the condensate water. The condensate water may be heated up by the steam which is then condensed into water and arranged to be discharged out of the sixth heat exchange compartment 611E through the sixth water outlet 614E.

The sixth main heater body 61E may comprise a sixth heat exchanging tube 615E and a sixth water collection head 616E connected to the sixth heat exchanging tube 615E, wherein the sixth water inlet 612E may be formed on the sixth water collection head 616E while the sixth heat exchange compartment 611E may be formed in the sixth heat exchanging tube 615E.

The sixth main heater body 61E may further comprise a sixth water discharging tube 617E extended from the sixth heat exchanging tube 615E, wherein the sixth water outlet 614E may be formed on the sixth water discharging tube 617E. Condensate water coming from the condenser 500F may sequentially pass through the sixth water inlet 612E, the sixth water collection head 616E, the sixth heat exchanging tube 615E, the sixth water discharging tube 617E, and the sixth water outlet 614E.

The sixth water collection head 616E may have a sixth water collection chamber 6161E. The sixth water inlet 612E may be formed on the sixth water collection head 616E and may communicate with the sixth water collection chamber 6161E. The sixth heat exchanging tube 615E may comprise a sixth external tube member 6151E and a sixth internal tube member 6152E for forming a double wall structure of the sixth heat exchanging tube 615E. The sixth steam inlet 613E may be formed on the sixth external tube member 6151E of the sixth heat exchanging tube 615E. A sixth receiving gap 6153E may be formed between the sixth external tube member 6151E and the sixth internal tube member 6152E. The sixth heat exchange compartment 611E may be formed inside the sixth internal tube member 6152E.

The sixth internal tube member 6152D may have a plurality of sixth holes 6154E formed thereon for communicating the sixth receiving gap 6153E with the sixth heat exchange compartment 611E. Thus, steam from the turbine 310F may enter the sixth heat exchanging tube 615E through the sixth steam inlet 613E.

The sixth injection nozzle 62E may be provided between the sixth water collection head 616E and the sixth heat exchanging tube 615E. The sixth injection nozzle 62E comprise a sixth nozzle base 621E and have a plurality of sixth injection holes 622E formed on the sixth nozzle base 621E, wherein the sixth injection holes 622E may communicate the sixth water collection chamber 6161E with the sixth heat exchange compartment 611E so that water collected in the sixth water collection chamber 6161E may be injected into the sixth heat exchange compartment 611E through the sixth injection holes 622E.

The sixth water discharging tube 617E may have a sixth guiding portion 6171E, a sixth pressurizing portion 6172E, and a sixth buffering portion 6173E extended between the sixth guiding portion 6171E and the sixth pressurizing portion 6172E. The sixth guiding portion 6171E may extend from the sixth heat exchanging tube 615E and may have a diameter gradually decreasing from the sixth heat exchanging tube 615E so as to form a tapered cross-section shape for collecting and guiding water flow in the sixth guiding portion 6171E.

The sixth pressurizing portion 6172E may extend from the sixth buffering portion 6173E and may have a diameter gradually increasing from the sixth buffering portion 6173E so that the water passing through the sixth pressurizing portion 6172E may have increasing pressure but decreasing flow rate.

The sixth injection feedwater heater 62E may further comprise a sixth safety arrangement 64E provided on the sixth heat exchanging tube 615E for preventing fluid, such as condensate water, from exiting the sixth heat exchanging tube 615E and reaching the turbine 310F through the sixth steam inlet 613E.

The sixth main heater body 61E may further comprise a sixth steam input tube 618E extending from the sixth external tube member 6151E, wherein the sixth steam inlet 613E is formed in the sixth steam input tube 618E. The sixth safety arrangement 64E may comprise a sixth unidirectional valve 641E mounted in the sixth steam input tube 618E for preventing water from exiting the sixth heat exchanging tube 615E and reaching the turbine 310F through the sixth steam inlet 613E.

The sixth safety arrangement 64E may further comprise a sixth electromagnetic valve 642E mounted on the sixth steam inlet 613E, and a plurality of sixth pressure sensors 643E provided in the sixth internal tube member 6152E and the sixth steam input tube 618E respectively for measuring the pressure in the sixth internal tube member 6152E and the sixth steam input tube 618E respectively. The sixth pressure sensors 643E may be electrically connected to the sixth electromagnetic valve 642E so that when the sixth pressure sensors 643E detect that the pressure in the sixth steam input tube 618E is lower than that of the sixth heat exchange compartment 611E, the sixth electromagnetic valve 642E may be arranged to turn off the corresponding pumping device 70F for stopping condensate water from further feeding into the sixth injection feedwater heater 60E.

Figure 17:
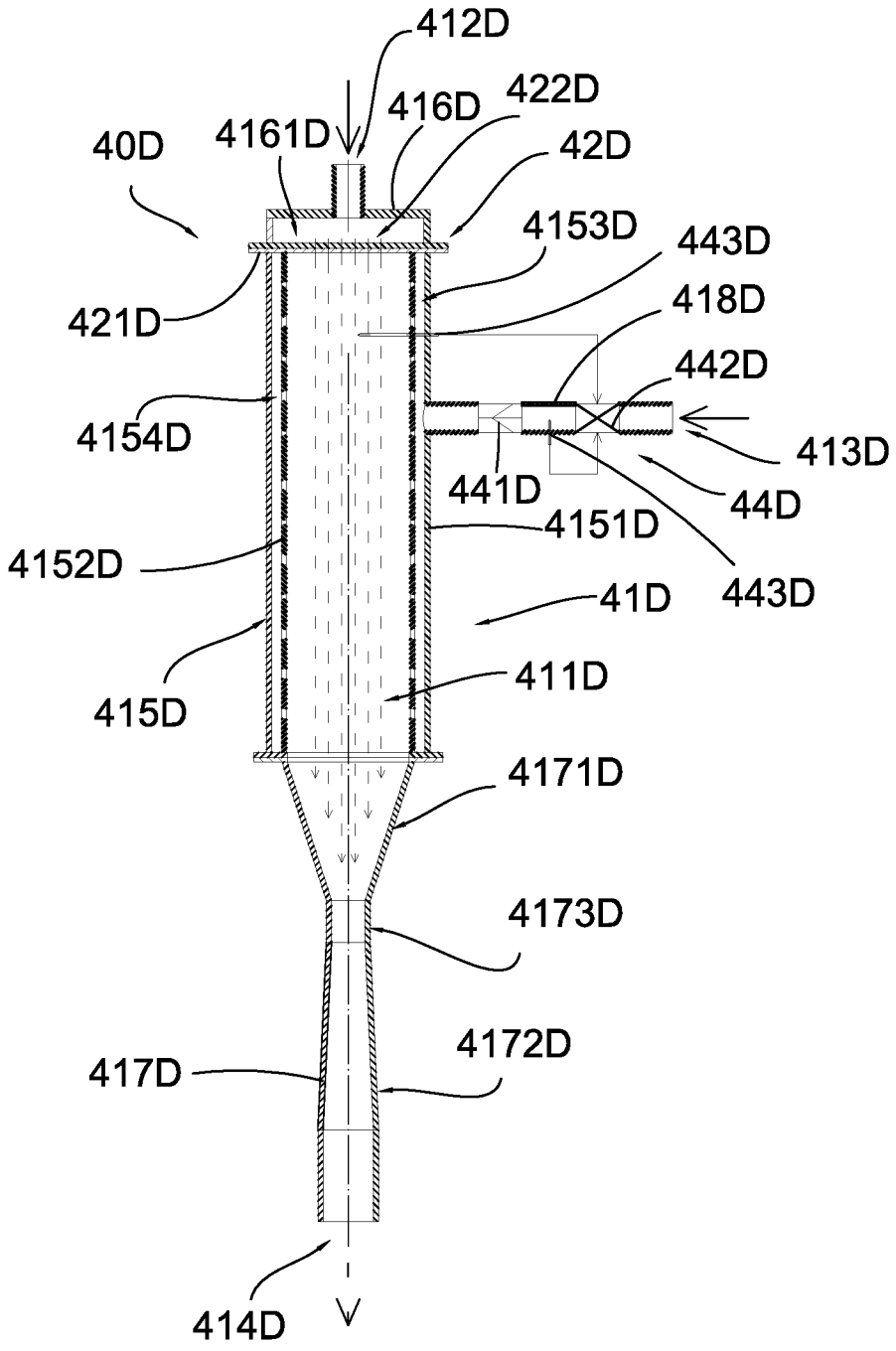
FIG. 17 is a schematic diagram of a fourth injection feedwater heater according to the fourth preferred embodiment of the present invention.

Referring to FIG. 17 of the drawings, in this fifth preferred embodiment, the first injection feedwater heater 10C and the second injection feedwater heater 20C may be connected in parallel with each other. The steam power generating system may comprise two deaerators 100F and three pumping devices 70F. The first injection feedwater heater 10C may connect to one of the deaerators 100F which may then connect to one of the pumping devices 70F and the third injection feedwater heater 30C in series. Moreover, the third injection feedwater heater 30C may be connected to the fifth injection feedwater heater 50E in series.

On the other hand, the second injection feedwater heater 20C may connect to another of the deaerators 100F which may then connect to another of the pumping devices 70F and the fourth injection feedwater heater 40D in series. Moreover, the fourth injection feedwater heater 40D may be connected to the sixth injection feedwater heater 60E in series. Each of the first through sixth injection feedwater heater 10C, 20C, 30C, 40D, 50E, 60E may be structurally identical and may be connected to the turbine assembly 300F.

Superheated steam may be generated in the steam generator 102F. The superheated steam may be guided to flow into the turbine assembly 300F comprising at least one turbine 310F. The turbine assembly 300F may also be connected to an electric generator 400F and a condenser 500F. The steam from the turbine assembly 300F may be guided to flow through the condenser 500F which may condense the steam into condensate water. The condenser 500F may be connected to a pumping device 70F and the first injection feedwater heater 10C and the second injection feedwater heater 20C. Note that the first injection feedwater heater 10C and the second injection feedwater heater 20C may be connected in parallel with respect to each other, while the first injection feedwater heater 10C and the second injection feedwater heater 20C may be connected in series with the condenser 500F and the pumping device 70F. This configuration is graphically depicted in FIG. 17 of the drawings.

The condensate water from the condenser 500F may be pumped to the first injection feedwater heater 10C and the second injection feedwater heater 20C at the same time through the first water inlet 112C and the second water inlet 212C respectively. Steam from the turbine assembly 300F may be fed into the first injection feedwater heater 10C and the second injection feedwater heater 20C through the first steam inlet 113C and the second steam inlet 213C respectively to perform heat exchange with the condensate water. After that, the condensate water may exit the first injection feedwater heater 10C and the second injection feedwater heater 20C through the first water outlet 114C and the second water outlet 214C.

As mentioned above, the first injection feedwater heater 10C and the second injection feedwater heater 20C may also be connected to two deaerator 100F respectively. Each of the deaerator 100F may be connected to the turbine assembly 300F for acquiring steam from at least one of the turbine 310F. The water coming out from the first injection feedwater heater 10C and the second injection feedwater heater 20C may enter the two deaerator 100F respectively. After that, water from the two deaerator 100F may be guided to flow into the third injection feedwater heater 30C and the fourth injection feedwater heater 40D respectively through two pumping devices 70F for further absorbing heat.

The water may then flow out of the third injection feedwater heater 30C and the fourth injection feedwater heater 40D and may be guided to flow into the fifth injection feedwater heater 50E and the sixth injection feedwater heater 60E respectively. The water in the fifth injection feedwater heater 50E and the sixth injection feedwater heater 60E may further absorb heat from the steam of the turbine 310F. Finally, the condensate water from the fifth injection feedwater heater 50E and the sixth injection feedwater heater 60E may exit through the fifth water outlet and the sixth water outlet 514E, 614E and go back to the steam generator 102F.

Note that in this fifth preferred embodiment of the present invention, condensate water from the condenser 500F may undergo three stages of pre-heating before going back to the steam generator 102F. The three stages of pre-heating may be accomplished by the first and the second injection feedwater heater 10C, 20C, the third and the fourth injection feedwater heater 30C, 40D, and finally the fifth and the sixth injection feedwater heater 50E, 60E.

The present invention, while illustrated and described in terms of a preferred embodiment and several alternatives, is not limited to the particular description contained in this specification. Additional alternative or equivalent components could also be used to practice the present invention.

What is claimed is:

1. An injection feedwater heater for a steam power generating system comprising at least one steam generator, at least one turbine assembly, at least one electric generator and at least one condenser, said injection feedwater heater comprising:

a main heater body having at least one heat exchange compartment, at least one water inlet, at least one steam inlet, and at least one water outlet formed on said main heater body; and at least one injection nozzle provided in said main heater body at a position adjacent to said water inlet, wherein a predetermined amount of condensate water is arranged to be pumped into said main heater body through said water inlet, said condensate water passing through said water inlet being arranged to be injected into said heat exchange compartment through said injection nozzle for creating a negative pressure in said heat exchange compartment, said negative pressure drawing a predetermined amount of steam to enter said heat exchange compartment through said steam inlet for mixing with said condensate water, said condensate water being heated up by said steam which is then condensed into water and arranged to be discharged out of said heat exchange compartment through said water outlet;

wherein said main heater body of said injection feedwater heater comprises at least one heat exchanging tube and at least one water collection head connected to said heat exchanging tube, wherein said water inlet is formed on said water collection head while said heat exchange compartment is formed in said heat exchanging tube.

2. The injection feedwater heater, as recited in claim 1, wherein said main heater body of said injection feedwater heater further comprises at least one water discharging tube extended from said heat exchanging tube, wherein said water outlet is formed on said water discharging tube, said condensate water being arranged to sequentially pass through said water inlet, said water collection head, said heat exchanging tube, said water discharging tube, and said water outlet.

3. The injection feedwater heater, as recited in claim 2, wherein said water collection head and said water discharging tube of said injection feedwater heater are provided on two opposite ends of said heat exchanging tube respectively.

4. The injection feedwater heater, as recited in claim 3, wherein said water collection head has at least one water collection chamber, said water inlet being formed on said water collection head and communicating with said water collection chamber.

5. The injection feedwater heater, as recited in claim 4, wherein said heat exchanging tube comprises at least one external tube member and at least one internal tube member for forming a multi-layer structure of said heat exchanging tube, said steam inlet being formed on said external tube member of said heat exchanging tube, a diameter of said internal tube member being less than that of said external tube member so as to form a receiving gap between said external tube member and said internal tube member, said heat exchange compartment being formed inside said internal tube member, said internal tube member having a plurality of holes formed thereon for communicating said receiving gap with said heat exchange compartment.

6. The injection feedwater heater, as recited in claim 5, wherein said injection nozzle comprises at least one nozzle base and has a plurality of injection holes formed on said nozzle base, wherein said injection holes are arranged to communicate said water collection chamber with said heat exchange compartment so that water collected in said water collection chamber is injected into said heat exchange compartment through said injection holes.

7. The injection feedwater heater, as recited in claim 6, wherein said water discharging tube has at least one guiding portion, at least one pressurizing portion, and at least one buffering portion extended between said guiding portion and said pressurizing portion, said guiding portion extending from said heat exchanging tube and having a diameter gradually decreasing from said heat exchanging tube so as to form a tapered cross-sectional shape of said guiding portion.

8. The injection feedwater heater, as recited in claim 7, wherein said main heater body further comprise at least one steam input tube extended from said external tube member, said steam inlet being formed in said steam input tube, said injection feedwater heater further comprising a safety arrangement provided in said steam input tube for preventing fluid from exiting said main heater body through said external tube member.

9. The injection feedwater heater, as recited in claim 8, wherein said safety arrangement comprises at least one unidirectional valve mounted in said steam input tube, at least one electromagnetic valve also mounted in said steam input tube, and a plurality of pressure sensors provided in said internal tube member and said steam input tube respectively for measuring said pressure in said internal tube member and said steam input tube respectively, said pressure sensors electrically connecting to said electromagnetic valve so that when said pressure sensors detect that a pressure in said steam input tube is lower than that of said heat exchange compartment said electromagnetic valve is arranged to turn off said corresponding pumping device for stopping condensate water from further feeding into said injection feedwater heater.

10. The injection feedwater heater, as recited in claim 9, wherein said water collection head and said water discharging tube are provided on two opposite ends of said heat exchanging tube respectively, one end portion of said heat exchanging tube is inclined with respect to longitudinal axis thereof.

11. The injection feedwater heater, as recited in claim 10, wherein said guiding portion of said water discharging tube has an inclined guiding surface, said water coming from said heat exchanging tube being arranged to hit said inclined guiding surface and guided to flow to said buffering portion.

12. The injection feedwater heater, as recited in claim 11, wherein said heat exchanging tube further has at least one water release port formed on said external tube member for allowing residual water to be discharged out of said receiving gap.

13. The injection feedwater heater, as recited in claim 9, wherein said heat exchanging tube of said injection feedwater heater has a curved portion formed adjacent to said guiding portion of said water discharging tube.

14. The injection feedwater heater, as recited in claim 13, wherein said guiding portion of said water discharging tube has an inclined guiding surface, said water coming from said heat exchanging tube being arranged to hit said inclined guiding surface and guided to flow to said buffering portion.

15. The injection feedwater heater, as recited in claim 9, wherein said guiding portion of said water discharging tube extends from said internal tube member along a longitudinal direction thereof, while said buffering portion and said pressurizing portion of said water discharging tube extend from said guiding portion along a transverse direction thereof, so that a longitudinal axis of said buffering portion and said pressurizing portion forms an approximately 90° angle of inclination with respect to a longitudinal axis of said guiding portion.

* * * * *